US008814316B2

(12) United States Patent
Kido

(10) Patent No.: US 8,814,316 B2
(45) Date of Patent: Aug. 26, 2014

(54) INKJET PRINTING APPARATUS WITH DEFECTIVE NOZZLE DETECTION

(75) Inventor: Hideyuki Kido, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 13/358,009

(22) Filed: Jan. 25, 2012

(65) Prior Publication Data

US 2012/0194600 A1 Aug. 2, 2012

(30) Foreign Application Priority Data

Jan. 31, 2011 (JP) ..... 2011-018946

(51) Int. Cl.
*B41J 29/393* (2006.01)

(52) U.S. Cl.
USPC ..... 347/19; 347/14

(58) Field of Classification Search
USPC ..... 347/5, 9, 14, 15, 16, 19, 104
See application file for complete search history.

(56) References Cited

U.S. PATENT DOCUMENTS 8,186,799 B2 * 5/2012 Morino et al. ..... 347/19

FOREIGN PATENT DOCUMENTS

JP 2006-205742 A 8/2006

* cited by examiner

*Primary Examiner* — Juanita D Jackson
(74) *Attorney, Agent, or Firm* — Fitzpatrick, Cella, Harper & Scinto

(57) ABSTRACT

Even if an image distortion is generated in an image acquired by reading out a test pattern by a reading device, an analysis region of a pattern for detecting an ejection state of a nozzle is accurately set to determine the ejection state of the nozzle. A control device is provided for controlling the reading device to read out the pattern, and a detecting device is provided to detect a defect of an ejection based upon a distribution state of a density in a pattern in the analysis region. The detecting device corrects a position of the analysis region on the readout image determined based upon an arrangement of each nozzle on a design, corresponding to the distribution state of the density in the pattern in the analysis region.

11 Claims, 13 Drawing Sheets

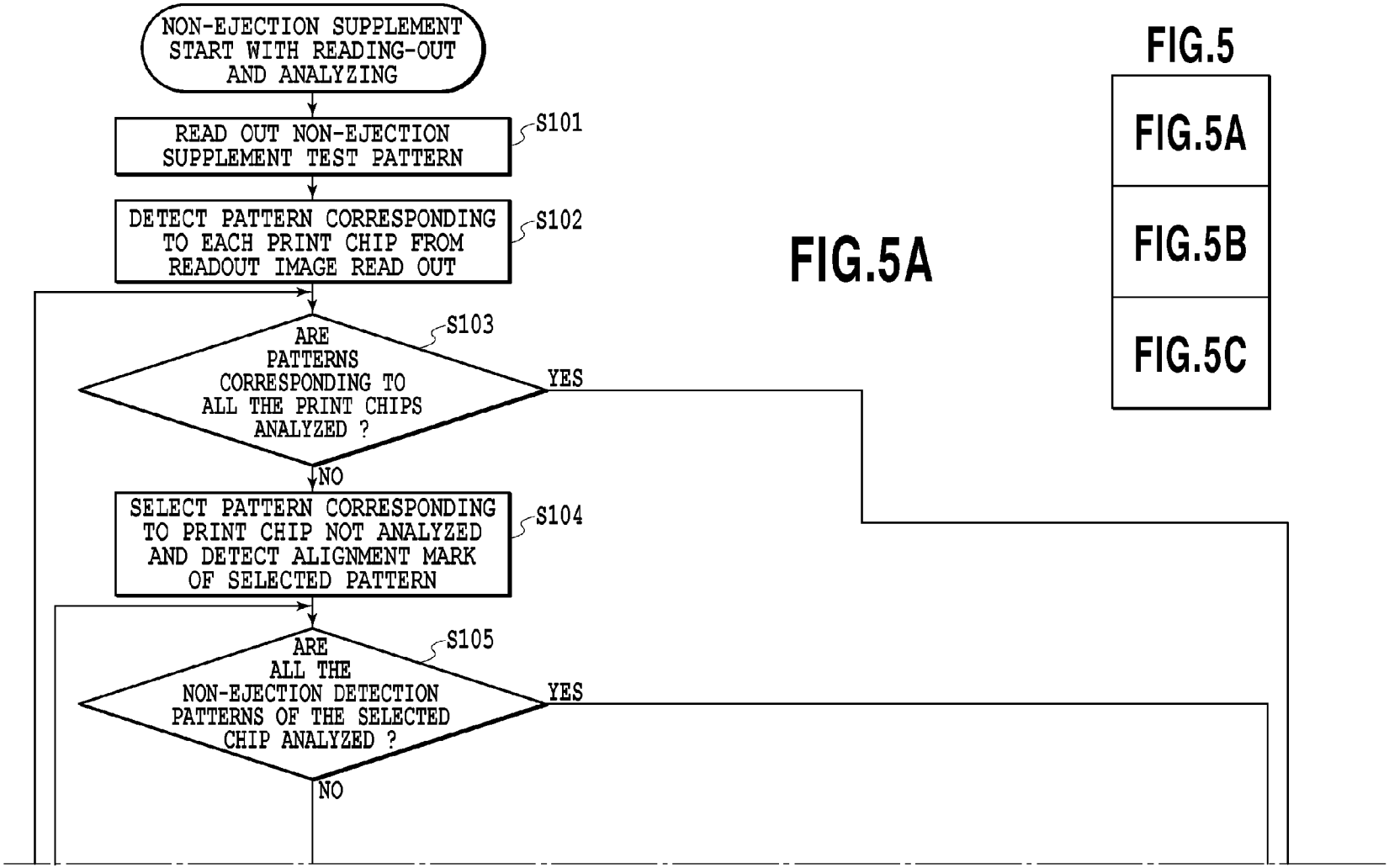
FIG.5
FIG.5A
FIG.5B
FIG.5C
FIG.5A
NON-EJECTION SUPPLEMENT START WITH READING-OUT AND ANALYZING
S101
READ OUT NON-EJECTION SUPPLEMENT TEST PATTERN
S102
DETECT PATTERN CORRESPONDING TO EACH PRINT CHIP FROM READOUT IMAGE READ OUT
S103
ARE PATTERNS CORRESPONDING TO ALL THE PRINT CHIPS ANALYZED ?
YES
NO
S104
SELECT PATTERN CORRESPONDING TO PRINT CHIP NOT ANALYZED AND DETECT ALIGNMENT MARK OF SELECTED PATTERN
S105
ARE ALL THE NON-EJECTION DETECTION PATTERNS OF THE SELECTED CHIP ANALYZED ?
YES
NO

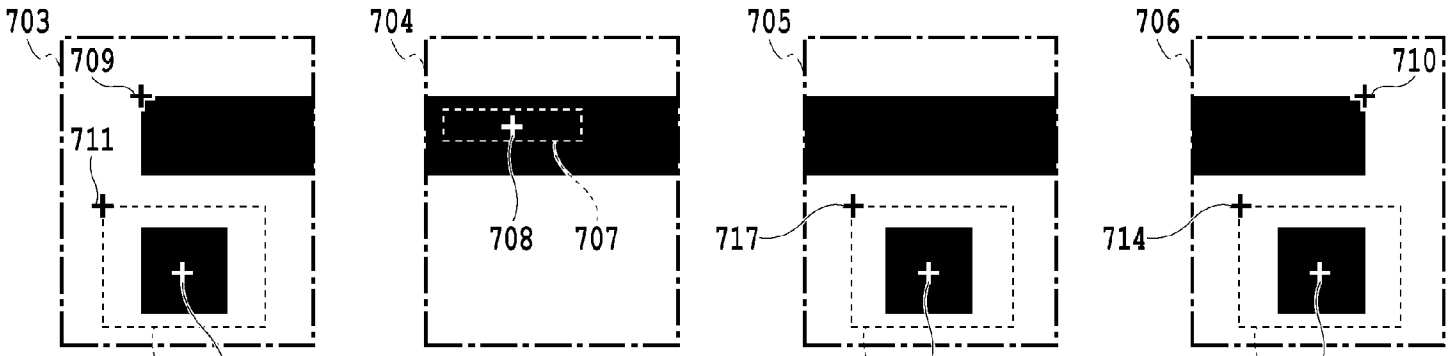
FIG.7B
FIG.7C
FIG.7D
FIG.7E
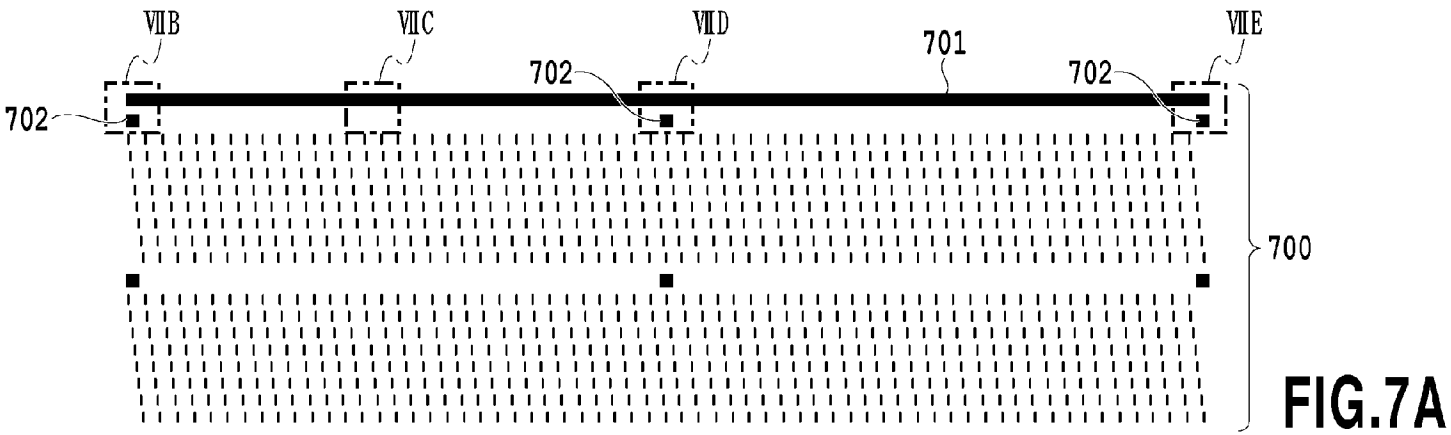
FIG.7A

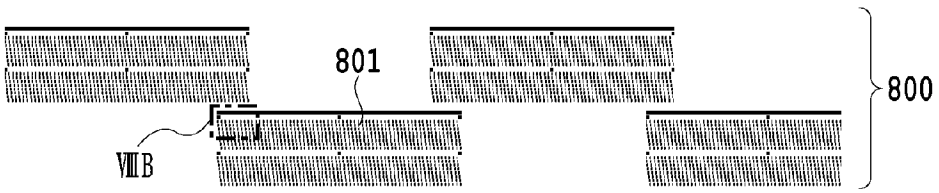
FIG.8A
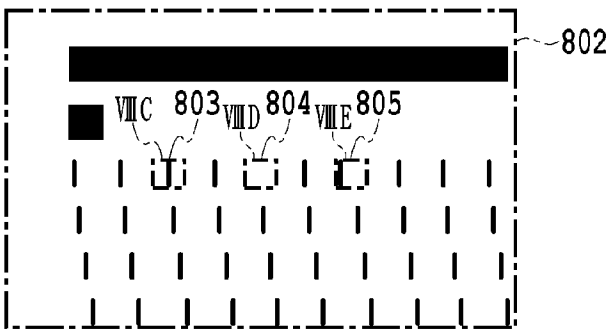
FIG.8B
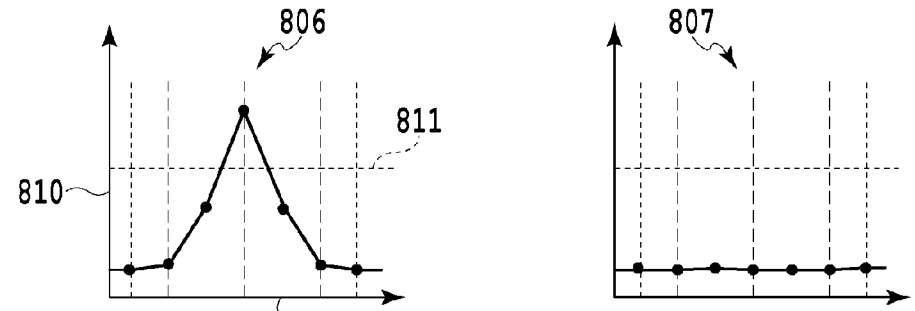
FIG.8C
FIG.8D
FIG.8E

NON-EJECTION DETECTION PATTERN 1101

NON-EJECTION DETECTION PATTERN 1102

NON-EJECTION DETECTION PATTERN 1103

NON-EJECTION DETECTION PATTERN 1104

NON-EJECTION DETECTION PATTERN 1105

INKJET PRINTING APPARATUS WITH DEFECTIVE NOZZLE DETECTION

BACKGROUND OF THE INVENTION

1. Field of the Invention

This invention relates to an inkjet printing apparatus, and in particular, to an inkjet printing apparatus for detecting a defective ejection of an inkjet nozzle in a print head of a full line type.

2. Description of the Related Art

A printing apparatus of an inkjet system is known as an apparatus for printing. The apparatus is equipped with a print head which ejects ink from nozzles arranged corresponding to a head resolution and fixes the ink on a print paper, thus forming characters and images thereon. The print head used in the printing apparatus of such an inkjet system is equipped with an energy generator for generating energy supplied to the ink for ejecting the ink as droplets from ejection openings. The print head is provided with an ink flow passage communicated with the ejection opening and ink accommodating device for accommodating ink supplied to the energy generator through the ink flow passage.

However, in a case of the print head in the inkjet system having this principle and structure, for example, in a case of having not used the print head for a long period of time, there are some cases where ink vaporizes from the ejection opening, which is solidified inside the nozzle or dusts or the like enters into the nozzle to clog the ejection opening. In addition, there are some cases where, due to foreign objects attached to the vicinity of the ejection opening, ink can not be ejected or a printing position of the ink is shifted. Further, there are some cases where air bubbles are generated inside the nozzle due to some cause, with which the nozzle is filled, and therefore, ink is not ejected, that is, so-called non-ejections are generated.

Even if such a defective ejection is generated, since the print head can not detect the defective ejection, there are some cases where even if printing is performed, ink is in fact not ejected at all or a droplet-hitting position of the ink is shifted. In addition, since a printing region corresponding to a width of a print medium is required in the full line type printing apparatus, an elongated print head is generally necessary, but when the print head is elongated, the number of nozzles in use increases depending on a printing density or a printing width to increase a generation rate of the defective ejection due to paper powder of the print medium, dusts or the like.

The nozzle in a state of such a defective ejection causes degradation of a quality in a printing image, and therefore there are proposed various methods for detecting the nozzle of the defective ejection to reduce an adverse effect of such a nozzle on the printing image.

An inkjet printing apparatus and an inkjet printing method disclosed in Japanese Patent Laid-Open No. 2006-205742 reads out an image printed on a print medium by reading device and detects a defective ejection nozzle from the read-out image. When the defective ejection nozzle is detected, control of image correction, a recovery operation of the defective ejection nozzle or replacement droplet hitting by a normal ejection nozzle is performed.

However, the aforementioned conventional technology has the following problem. In Japanese Patent Laid-Open No. 2006-205742, an ejection state of each nozzle in the print head is determined based upon dots of the ejected ink. Therefore, a test pattern is printed by the print head and the printed test pattern is read out by the reading device. However, this publication does not disclose an adverse effect of an image distortion at the time of reading out the test pattern by the reading device or a technique for overcoming the effect. There are some cases where, upon reading out the image by the reading device, the readout image is distorted due to generation of optical aberration. Caused by the effect of the image distortion by the aberration, in spite of the fact that droplets of ink are normally hit, a position of an analysis region is shifted, and therefore, there occurs a problem that a defective ejection determination or a defective ejection direction determination is made based upon the analysis on the region shifted from the droplet hitting position. In addition, there occurs a problem that a pattern of the neighboring nozzle is erroneously detected due to the position shift of the analysis region and therefore a droplet hitting control for replacement is performed for the erroneous nozzle. Particularly in a case of using the print head with a high printing density, since the patterns corresponding to the nozzle are densely formed, higher detection accuracy to the pattern position is required in the process of detecting the defective ejection.

SUMMARY OF THE INVENTION

The present invention is made in view of the aforementioned problem. Therefore, an object of the present invention is to provide a technique that, even if an image distortion is generated in an image acquired by reading out a test pattern by reading device, an analysis region of a pattern for detecting an ejection state of a nozzle is accurately detected to determine the ejection state of the nozzle.

An inkjet printing apparatus according to the present invention is provided with an inkjet printing apparatus for ejecting ink from a print head for printing, comprising printing device for printing a pattern for detecting a defect in an ejection of ink in the print head, reading device for reading out the printed pattern as an image, correcting device for analyzing a hitting state of the ink for each analysis region from the image of the pattern read out by the reading device to correct a position of the analysis region, and detecting device for detecting the defect in the ejection of the ink in the print head based upon the position of the analysis region corrected by the correcting device.

According to the present invention, the inkjet printing apparatus comprises printing device for printing a pattern for detecting a defect in an ejection of ink in the print head, and reading device for reading out the printed pattern as an image. The printing apparatus further comprises correcting device for analyzing a hitting state of the ink for each analysis region from the image of the pattern read out by the reading device to correct a position of the analysis region, and detecting device for detecting the defect in the ejection of the ink in the print head based upon the position of the analysis region corrected by the correcting device. Therefore, the printing apparatus can realize a technique that, even in a case where an image distortion is generated in the image acquired by reading out a test pattern by the reading device, an analysis region of a pattern for detecting the ejection state of the nozzle is accurately detected to determine the ejection state of the nozzle.

Further features of the present invention will become apparent from the following description of exemplary embodiments (with reference to the attached drawings).

BRIEF DESCRIPTION OF THE DRAWINGS

FIG. 5 is a diagram showing the relationship of FIGS. 5A, 5B, and 5C;

FIG. 5A is a flow chart explaining readout of the non-ejection supplement and the procedure of the analysis;

FIG. 7A is a diagram explaining a process of detecting a detection mark and an alignment mark from a readout image of the test pattern;

FIG. 7B is a diagram explaining a process of detecting a detection mark and an alignment mark from a readout image of the test pattern;

FIG. 7C is a diagram explaining a process of detecting a detection mark and an alignment mark from a readout image of the test pattern;

FIG. 7D is a diagram explaining a process of detecting a detection mark and an alignment mark from a readout image of the test pattern;

FIG. 7E is a diagram explaining a process of detecting a detection mark and an alignment mark from a readout image of the test pattern;

FIG. 8A is a diagram explaining a process of determining an ejection state of a nozzle;

FIG. 8B is a diagram explaining a process of determining an ejection state of a nozzle;

FIG. 8C is a diagram explaining a process of determining an ejection state of a nozzle;

FIG. 8D is a diagram explaining a process of determining an ejection state of a nozzle;

FIG. 8E is a diagram explaining a process of determining an ejection state of a nozzle;

DESCRIPTION OF THE EMBODIMENTS

Hereinafter, embodiments according to the present invention will be explained with reference to the accompanying drawings. It should be noted that the following embodiments are simply described as examples, and will not limit the scope of the present invention. In addition, a relative arrangement of respective components, configurations, and like of apparatuses used in the embodiment are simply described as examples, and the present invention is not limited thereto.

Figure 1:
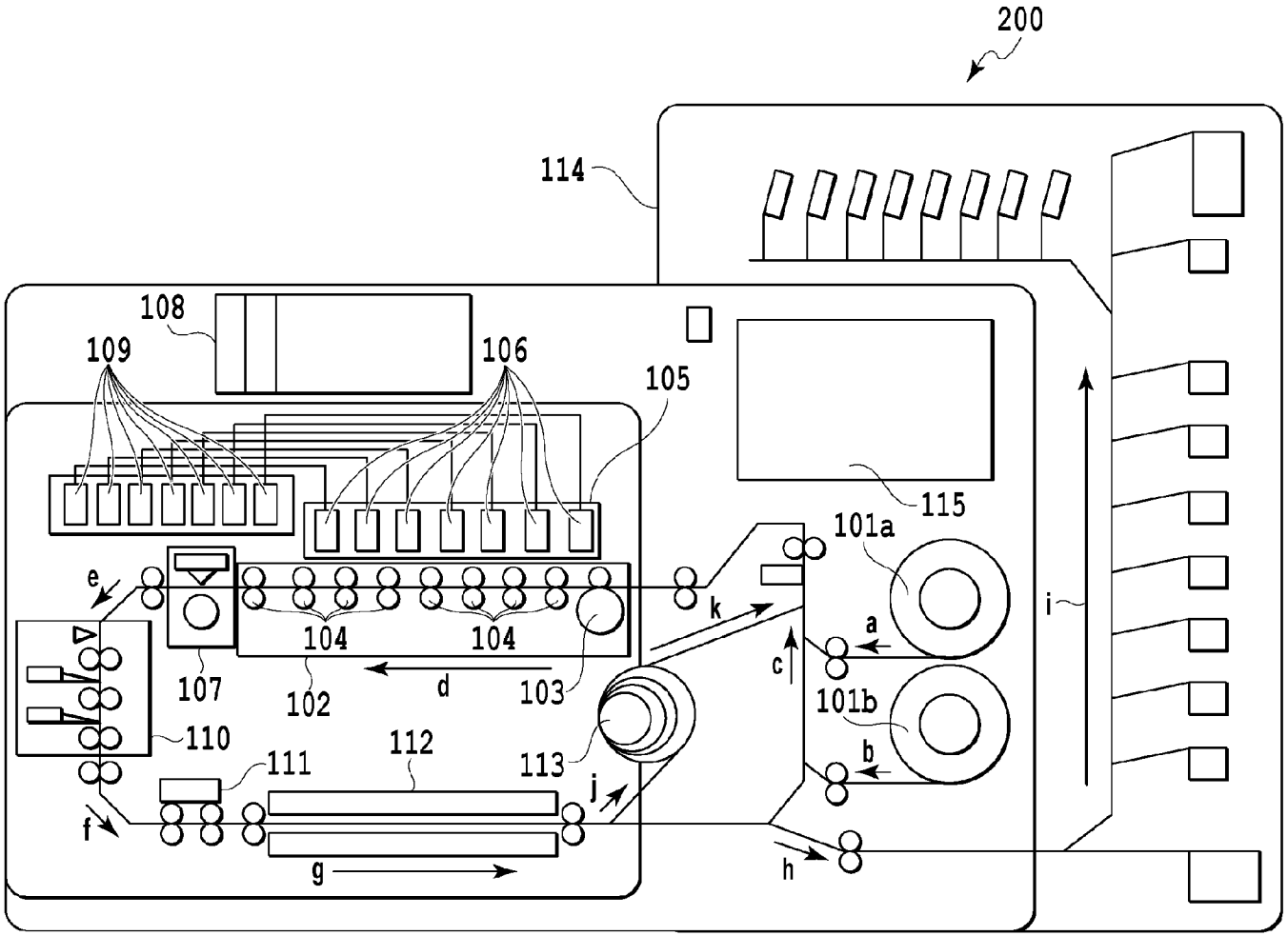
FIG. 1 is a diagram showing a schematic construction of an image forming apparatus according to an embodiment in the present invention.

FIG. 1 is a diagram showing a schematic construction of an image forming apparatus as an example of a printing control apparatus (inkjet printing apparatus) according to the present embodiment. The image forming apparatus in FIG. 1 shows an apparatus provided with a printing function and a readout function of reading out an mage on a paper, but may be a multiple apparatus including other functions. In addition, an example of using a roll sheet as a print member (print medium or print sheet) subjected to a printing process will be explained, but the print member is not limited to a roll-shaped material as long as it is an elongated and sequential sheet enabling the printing corresponding to a plurality of pages on the same plane to be sequentially performed without interruption in the halfway. Further, cutting of the sequential sheet may be automatically carried out by the image forming apparatus or based upon a manual instruction by a user.

A material of the print member is not limited to a paper, and various kinds of materials may be used as the print member as long as it allows the printing process. The image forming apparatus may be an image forming apparatus which can perform not only printing to a sequential sheet, but also printing to cut sheets which are acquired by in advance cutting the sequential sheet in a predetermined size. A printing system is not limited to a system of printing an image by an inkjet system using liquid ink for image printing to be described later, but may adopt solidified ink as a printing agent. The printing is not limited to color printing using printing agents of a plurality of colors, but may be monochromatic printing using only a black color (including gray).

The printing is not limited to printing of a visible image, but may be printing of a non-visible image or an image difficult to visualize, and further, may be printing of various types of images other than a general image, for example, a wiring pattern, a physical pattern in the manufacture of parts, and a print of a base arrangement of DNA or the like. That is, as long as a printing agent can be applied to a print member in printing, the printing can be applied to various types of printing apparatuses. In a case of controlling an operation of the printing process in an image forming apparatus in FIG. 1 by an instruction from an external apparatus connected to the image forming apparatus, the external apparatus serves as a printing control apparatus.

FIG. 1 is a cross section showing an outline of the entire construction in an image forming apparatus using a roll sheet (a sequential sheet longer than a length of a printing unit (one page) in the conveyance direction) as a print member. The image forming apparatus includes the following components 101 to 115, which are arranged inside one casing. However, these components may be constructed in such a manner as to be divided into a plurality of casings for accommodation.

A control unit 108 houses therein a controller (including a CPU and a MPU), an output device (generator of display information, audio information, and the like) of user interface information, and a control unit equipped with various kinds of I/O interfaces, and manages various controls of the entire image forming apparatus. A roll sheet unit comprises two devices of an upper sheet cassette 101*a* and a lower sheet cassette 101*b*. A user attaches a roll sheet (hereinafter, called a sheet) to a magazine, which is incorporated into the image forming apparatus body. The sheet pulled out from the upper sheet cassette 101*a* is conveyed in the direction of an arrow a in the figure, and the sheet pulled out from the lower sheet cassette 101*b* is conveyed in the direction of an arrow b in the figure. The sheet pulled out from any of the cassettes advances in the direction of an arrow c in the figure and arrives at a conveyance unit 102. The conveyance unit 102 conveys the sheet in the direction of an arrow d (horizontal direction) in the figure through a plurality of rotating rollers 104 during the process of printing. At the time of changing the sheet cassette of a feed source from one to the other, the pulled-out sheet is wound back into the cassette and a sheet is newly fed from the cassette in which sheets to be newly fed are set.

A print head unit 105 is arranged above the conveyance unit 102 to be opposed to the conveyance unit 102. Independent print heads 106 corresponding to plural colors (seven colors in the present embodiment) are held in the print head unit 105 along the conveyance direction of the sheet. In the present example, seven print heads corresponding to seven colors of K (black), M (magenta), C (cyan), Y (yellow), G (gray), LM (light magenta), and LC (light cyan) are provided. Without mentioning, the print head using a color other than these colors may be used and it is also not required for the print head to use all the colors. The image forming apparatus ejects ink from the print head 106 in synchronization with the conveyance of the sheet by the conveyance unit 102 to form an image on the sheet. It should be noted that the print head 106 is arranged in a position where the ejection destination of ink does not overlap the rotating roller 104.

In addition, instead of directly ejecting the ink on the sheet, the ink may be applied to an intermediate transcriptional body and thereafter, the ink is applied to the sheet to form an image thereon. A printing unit is constructed to include the conveyance unit 102, the print head unit 105, and the print heads 106. Ink tanks 109 independently store inks of respective colors therein. Inks are supplied from the ink tanks 109 via tubes to sub tanks provided corresponding to the respective colors, and the inks are supplied from the sub tanks via tubes to the respective print heads 106. In the print heads 106, line heads of respective colors (seven colors in the present embodiment) line up along the conveyance direction (direction of an arrow d) at printing.

The line heads of the respective colors may be formed by a single print chip without a connecting joint or by divided print chips lining up regularly in one line or in a staggered array. The present embodiment adopts a so-called full multi-head in which nozzles line up in a range for covering a width of the printing region of the sheet having the maximum size usable in the present apparatus. The inkjet system for ejecting ink from the nozzle may adopt a system for using a heater element, a system for using a piezo element, a system for using an electrostatic element, a system for using a MEMS element, and the like. Ink is ejected from the nozzle in each head based upon printing data, and timing of the ejection is determined by an output signal of a conveyance encoder 103. It should be noted that the present embodiment is not limited to a printer of an inkjet system using ink as a printing agent, and may be applied to various types of printing systems, such as a thermal printer (a sublimation printer, a heat thermal printer, and the like), and a dot impact printer.

The sheet on which an image is formed is conveyed from the conveyance unit 102 to a scanner unit 107. The scanner unit 107 optically reads out the printed image or a specific pattern on the sheet to confirm whether or not the printed image has a problem, a state of the present apparatus including an ejection state of the ink, or the like. According to the present embodiment, in a method of confirming the image on the sheet, a pattern for confirming an ejection state of the print head is read out to confirm the ejection state of the ink, but success of the printing may be confirmed by comparison of the printed image with an original image. The method of the confirmation may be selected from various methods as needed.

The sheet is conveyed in the direction of an arrow e from the vicinity of the scanner unit 107 and is introduced into a cutter unit 110. The cutter unit 110 cuts the sheet to pieces each having a length of a predetermined printing unit. The length of the predetermined printing unit differs depending on an image size to be printed. For example, in a photograph of an L-size, a length of the sheet in the conveyance direction is 135 mm, and in a photograph of an A4-size, a length of the sheet in the conveyance direction is 297 mm. The cutter unit 110 cuts the sheet in a page unit in a case of one-side printing, but there are some cases where the sheet is not cut in a page unit depending on a content of a printing job. In addition, the cutter unit 110, in a case of both-side printing, does not cut the first surface of the sheet (for example, top surface) in a page unit, and images are sequentially printed until a predetermined length of the sheet. In a case of having printed the second surface (for example, back surface), the cutter unit 110 cuts the sheet in a page unit. It should be noted that the cutter unit 110 does not necessarily cut the sheet in the image unit of each one sheet in one-side printing and both-side printing. The sheet is not cut until the sheet is conveyed by a predetermined length, but is cut after being conveyed by the predetermined length. Cut and separation of the sheet on a basis of the image unit of each one sheet (each one page) may be carried out manually by a different cutter device. In a case of requiring the cutting of a sheet in regard to a width direction of the sheet, a different cutter device is supposed to be used for the cutting.

The sheet conveyed from the cutter unit 110 is conveyed within the unit in the direction of an arrow f in the figure to a backside printing unit 111. The backside printing unit 111 is a unit for printing predetermined information on the backside of the sheet in a case of printing an image only on the one side of the sheet. The information to be printed on the backside of the sheet includes information of characters, symbols, codes, and the like corresponding to each printed image (for example, the number for order management). The backside printing unit 111, in a case where the print head 106 prints an image for a printing job of both-side printing, prints the above information in a region other than the region where the print head 106 prints the image. The backside printing unit 111 can adopt methods of imprint, heat transcription, inkjet, or the like of a printing agent.

The sheet which has passes through the backside printing unit 111 is next conveyed to a drying unit 112. The drying unit 112 is, for drying the ink-applied sheet for a short time, a unit for heating the sheet passing through the unit in the direction of an arrow gin the figure by a warm wind (heated gas (air)). It should be noted that the drying method, instead of using a warm wind, may include various methods such as a cooling wind, heating by a heater, natural drying only by waiting, and irradiation of an electromagnetic wave such as ultraviolet light. The sheets cut, each having a length of a printing unit, pass through the drying unit 112 one by one and are conveyed in the direction of an arrow h in the figure to a sorting unit 114. The sorting unit 114 holds a plurality of trays (18 trays in the present embodiment) and sorts the tray for a discharge destination of the sheet corresponding to a length of a printing unit or the like.

A tray number is assigned to each tray. The sorting unit 114 discharges the sheet passing through the unit in the direction of an arrow i in the figure to a tray in accordance with the tray number set for each printed image while confirming whether the tray is vacant or full of sheets by a sensor provided on each tray. There is a case where the tray as the discharge destination of the cut sheet is particularly designated by a request source (host apparatus) of a printing job, or a vacant tray is arbitrarily designated in a side of the image forming apparatus. The sheets can be discharged to one tray by a predetermined number. In a case of a printing job over the predetermined number of the sheets, the sheets are discharged over a plurality of trays. A number, a size, and a kind of the sheet which can be discharged to the tray differ depending on a size (type) and the like of the tray.

In FIG. 1, a sheet in a large size (sheet larger than an L-size, such as an A4-size) and a sheet in a small size (sheet in an L-size) can be discharged to trays (hereinafter, called large tray) lining up vertically (upper-lower direction). In addition, a sheet in a small size (sheet in an L-size) can be discharged to trays (hereinafter, called small tray) lining up horizontally (right-left direction), but a sheet in a large size can not be discharged thereto. The output number of the sheets, which can be discharged to the large tray, is more than to the small tray. A user can use a display device (for example, LED) to identify a conveyance state, such as the middle of sheet discharging or completion of sheet discharging.

For example, a plurality of LEDs emitting light in different colors with each other are provided in the trays respectively, and various states of the respective trays can be notified to a user based upon a color, a light-on state or a light-off state of the lighting LED, or the like. A priority order can be applied to each of the plurality of trays. The image forming apparatus 200 sequentially assigns a vacant tray (tray where a sheet is not present) as a discharge destination of the sheet according to the priority order for performing a printing job. In the default, a large tray has a higher priority order in the order from lower to upper trays, and a small tray has a higher priority order closer to the left side. The priority order of the small tray is higher than the large tray. The priority order of the tray in a position where a user can easily take out sheets may be set higher, but can be changed as needed by an operation of a user or the like.

A sheet rolling-up unit 113 rolls up a sheet in a sequential state on a top surface of which a plurality of pages are printed. In a case of both-side printing, the sheet on the top surface of which the image is formed is not cut in a page unit. A plurality of images are sequentially printed on the top surface of the sequential sheet, and the sequential sheet is cut upstream of a final image on the surface by the cutter unit 110. The sheet on the top surface of which the image is printed is conveyed in the direction of an arrow j in the figure and is rolled up by the sheet rolling-up unit 113. The sheet, in which the image formation on the top surface corresponding to a series of pages is completed, and which is rolled up, is conveyed in the direction of an arrow k in the figure in such a manner as to set a rear end at the time of printing on the surface as the leading end.

At this time, the sheet is reversed in regard to front and back sides in such a manner that a surface opposite to the top surface on which the printing is performed faces the print head 106. The sheet is conveyed by the conveyance unit 102, and an image is printed on the backside of the sheet by the print head unit 105. In a case of regular one-side printing, the sheet on which the image is printed is conveyed to the sorting unit 114 without the rolling-up by the sheet rolling-up unit 113.

In this manner, in a case of both-side printing, the sheet is rolled up by using the sheet rolling-up unit 113 and is reversed to perform printing onto the backside. Therefore, a surface of the sheet at the time of the discharging to the sorting unit 114 differs between at one-side printing and at both-side printing. That is, since the sheet is not reversed by using the sheet rolling-up unit 113 in a case of one-side printing, the sheet in which an image on the leading page is printed is discharged in a state where the image on the leading page is oriented downward. In addition, in a case of a job where one printing job includes a plurality of pages, the sheet of the leading page is discharged to the tray and thereafter, the sheet of the following page is sequentially discharged so that the sheets stack one by one.

This discharge is called face-down discharge. Meanwhile, in a case of both-side printing, the sheet is reversed by using the sheet rolling-up unit 113. Therefore, the sheet in which an image on the leading page is printed is discharged in a state where the image on the leading page is oriented upward. In addition, in a case of a job where one printing job outputs a plurality of sheets, the sheet including a final page is first discharged to the tray and thereafter, the sheet of the earlier page is sequentially discharged so that the sheets stack. Finally, the sheet in which an image on the leading page is printed is discharged. This discharge is called face-up discharge.

An operating unit 115 is a unit used for a user to perform various operations and for notifying various pieces of information to a user. For example, it is possible to confirm on which tray the sheet, on which an image designated by a user is printed, is loaded or confirm a printing situation of an image for each order, for example, whether the image is in the middle of printing or under completion of printing. In addition, a user can perform the operating unit 115 for confirmation of various states of the apparatus such as an ink remaining amount or a remaining amount of sheets, and for performing an instruction of implementation of apparatus maintenance such as head cleaning.

Figure 2:
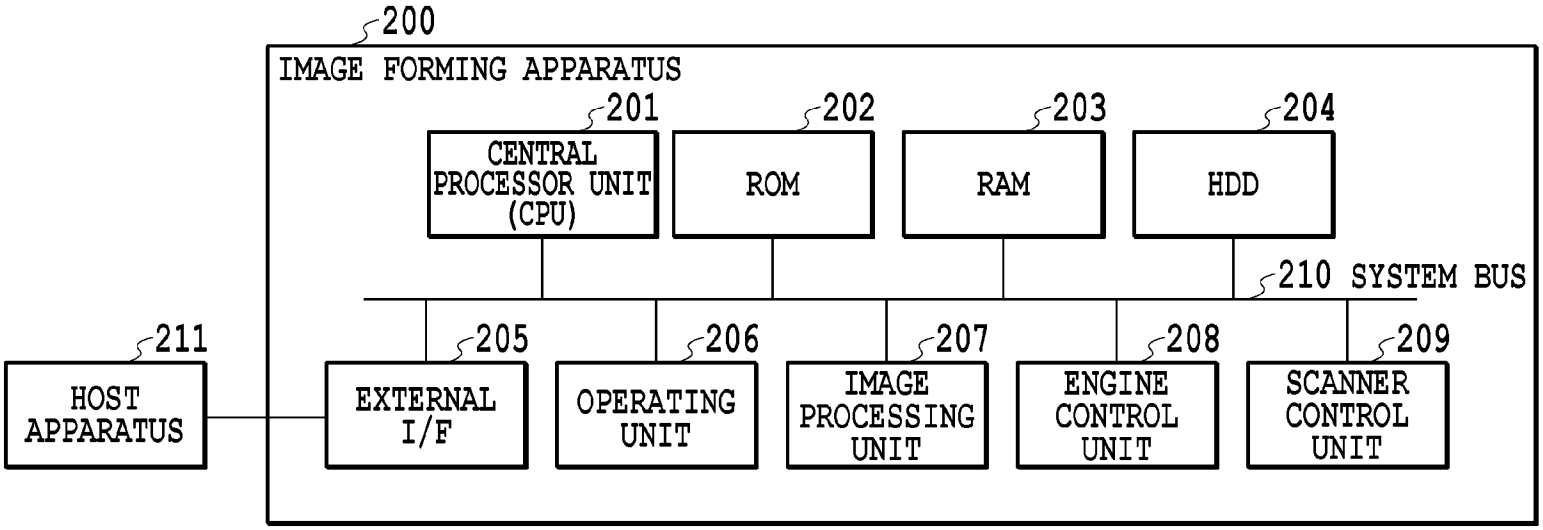
FIG. 2 is a block diagram explaining a construction in regard to control for the image forming apparatus in FIG. 1.

FIG. 2 is a block diagram explaining the construction in regard to control of the image forming apparatus 200 in FIG. 1 according to the present embodiment. A control unit 108 mainly includes a CPU 201, a ROM 202, a RAM 203, an image processing unit 207, an engine control unit 208, and a scanner control unit 209. An HDD 204, an operating unit 206, an external I/F 205, and the like are connected via a system bus 210 to the engine control unit 108. The CPU 201 is a central computation processing unit in the form of a microprocessor (microcomputer) and is included in the control unit 108 in FIG. 1. The CPU 201 controls an operation of the entire image forming apparatus 200 by execution of programs or activation of hardware.

The ROM 202 stores therein programs executed by the CPU 201 and fixed data required for various operations of the image forming apparatus 200. The RAM 203 is used as a work area of the CPU 201, is used as a temporal storage region of various reception data, and stores various setting data therein. The HDD 204 stores programs executed by the CPU 201, printing data, and setting information required for various operations of the image forming apparatus 200 in a hard disc incorporated therein, and reads them out from the hard disc. It should be noted that instead of the HDD 204, another storage apparatus of a large capacity may be used.

The operating unit 206 includes hard keys and a touch panel for a user to perform various operations or a display unit for indicating (notifying) various pieces of information to a user, and corresponds to the operating unit 115 in FIG. 1. The indication of the information to a user may be also made by outputting audio (buzzer, voices or the like) based upon audio information from a voice generator. The image processing unit 207 performs development (conversion) of printing data (for example, data expressed in a page description language) processed by the image forming apparatus 200 to image data (bit map image) or an image process of the image data. A color space (for example, YCbCr) of the image data included in the input printing data is converted into a standard RGB color space (for example, sRGB). Various image processes such as resolution conversion to the effective pixel number (printable by the image forming apparatus 200), image analysis, and image correction are executed to the image data as needed. The image data acquired by these image processes is stored in the RAM 203 or the HDD 204.

The engine control unit 208 performs control of the process of printing an image based upon the printing data on a sheet in response to a control command received from the CPU 201 or the like. The engine control unit 208 carries out an ink ejection instruction to the print head 106 of each color, ejection timing setting thereof for adjusting a dot position (hitting position of ink) on a print medium, adjustment thereof based upon obtaining a head drive state, and the like. Drive control of the print head is performed corresponding to the printing data and ink is ejected from the print head to form an image on a sheet. In addition, a drive instruction of a feed roller, and control of a conveyance roller such as a drive instruction of the conveyance roller and the obtaining of a rotation situation of the conveyance roller are carried out, and the sheet is conveyed in an appropriate speed and route and is stopped.

The scanner control unit 209 performs control of an image sensor in response to a control command received from the CPU 201 or the like, reads out the image on the sheet, and obtains analogue luminance data of colors of red (R), green (G), and blue (B), which is converted into digital data. A CCD image sensor, a CMOS image sensor or the like may be adopted as the image sensor. In addition, the image sensor may be a linear image sensor or an area image sensor. The scanner control unit 209 performs a drive instruction of the image sensor, obtains a situation of the image sensor based upon the drive of the image sensor, analyzes the luminance data obtained from the image sensor, and detects non-ejection (defect of ejection) of ink from the print head 106 or a cutting position of the sheet. The sheet on which the image is determined to be correctly printed by the scanner control unit 209, after the drying process is performed to ink on the sheet, is discharged to the designated tray in the sorting unit.

The host apparatus 211 is an apparatus which is connected to an outside of the image forming apparatus 200 corresponding to the aforementioned external apparatus and is a supply source of image data for making the image forming apparatus 200 perform printing, and issues the order of various printing jobs. The host apparatus 211 may be realized as a general-purpose personal computer (PC) or another type of data supply apparatus. An image capture apparatus for capturing an image to generate image data is present as the other type of data supply apparatus. The image capture apparatus includes a reader (scanner) for reading out an image on a paper to generate image data, a film scanner for reading out a negative film or a positive film to generate image data or the like.

Other examples of the image capture apparatus include a digital camera for photographing a still image to generate digital image data and a digital video for photographing a moving image to generate moving image data. Besides, by installing a photo storage on a network and by providing a socket into which a removal conveyable memory is inserted, an image file stored in the photo storage or the conveyable memory may be read out to form image data for printing. Instead of the general-purpose PC, a terminal exclusive to the image forming apparatus may be used or various types of data supply apparatus may be used. The data supply apparatus may be a construction element in the image forming apparatus or another apparatus connected to an outside of the image forming apparatus.

In a case of using a PC as the host apparatus 211, an OS, application software for generating image data, and a printer driver for the image forming apparatus 200 are installed in the storage apparatus of the PC. The printer driver controls the image forming apparatus 200 or converts image data supplied from the application software into the form which can be processed by the image forming apparatus 200 to generate printing data. In addition, conversion from printing data to image data may be performed in a side of the host apparatus 211, which is then supplied to the image forming apparatus 200. It should be noted that it is not necessarily required to realize all the above processes by software, but a part or all of the processes may be realized by hardware.

Image data, other commands, further, status signals, and the like supplied from the host apparatus 211 can be transmitted via the external I/F 205 to or from the image forming apparatus 200. The external I/F 205 may be a local I/F or a network I/F. In addition, the external I/F 205 may be connected by wiring or by wireless. The respective above components in the image forming apparatus 200 are connected via the system bus 210 to be transmittable with each other.

In the above example, the single CPU 201 controls all the components in the image forming apparatus 200 shown in FIG. 2, but a different construction may be adopted. That is, some of the functional blocks may be equipped with CPUs individually to be individually controlled by the respective CPUs. The respective functional blocks may adopt various forms, for example, by a sharing method other than the construction sharing shown in FIG. 2, may be divided as individual processing units or controlled units as needed or some thereof may be united. For reading out data from the memory, a DMAC (direct memory access controller) may be used.

Figure 3:
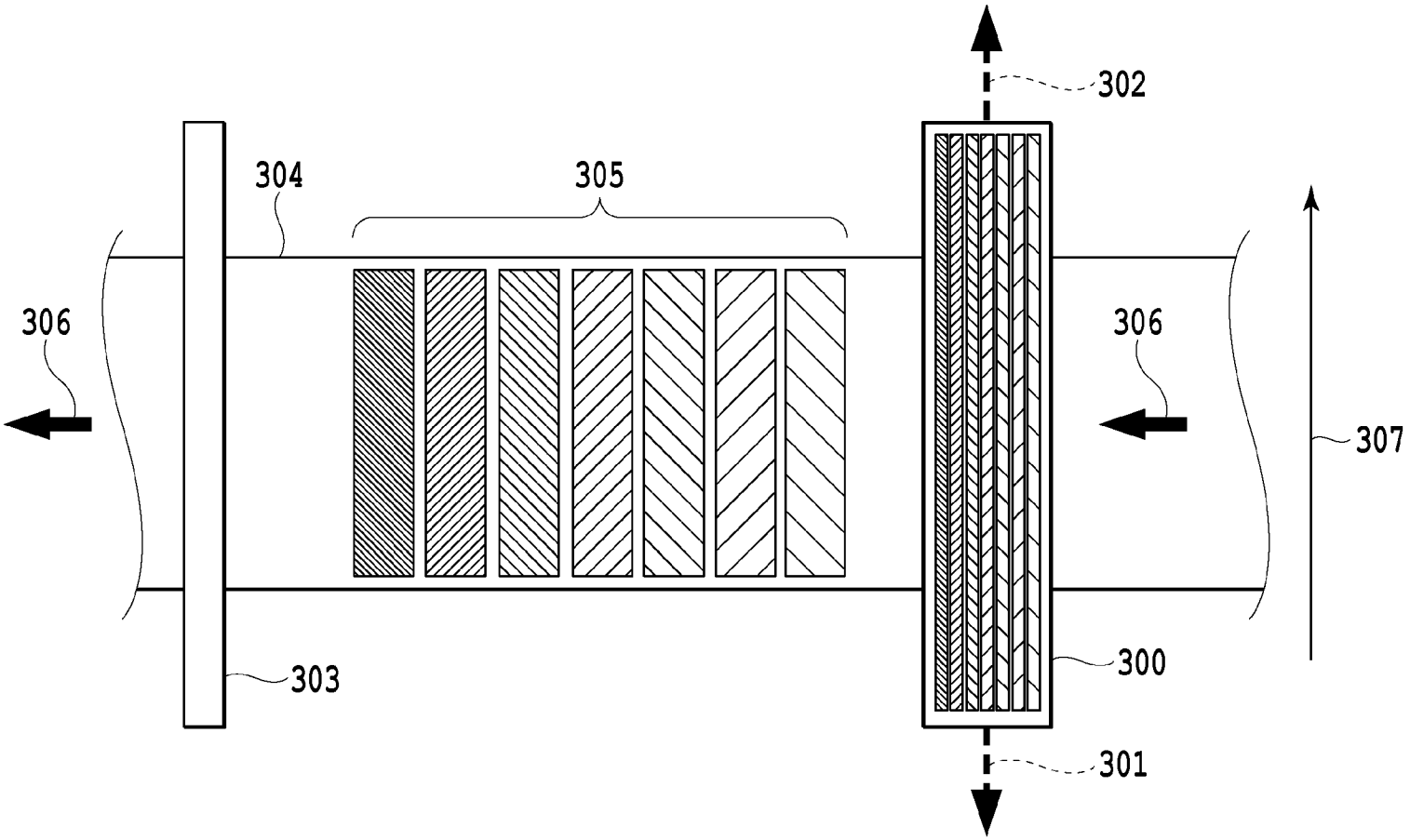
FIG. 3 is a diagram explaining a print medium and a periphery of a print head unit.
Figure 4A:
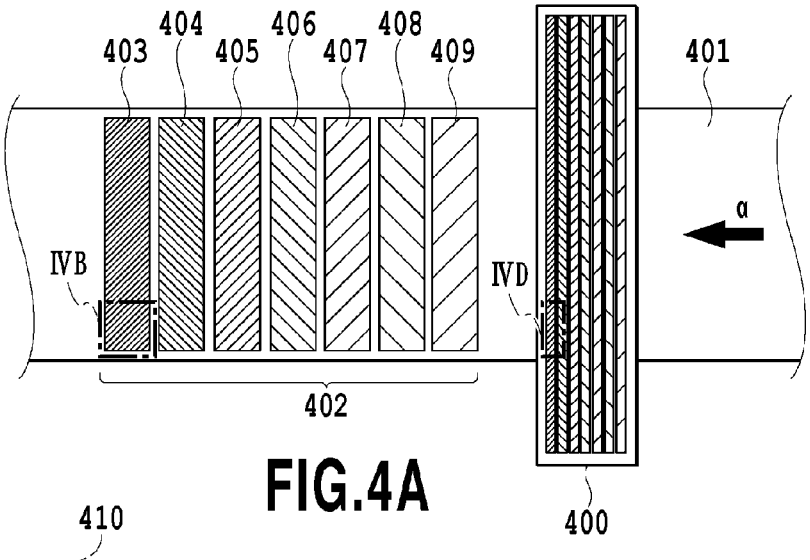
FIG. 4A is a diagram explaining a printing method of a test pattern of non-ejection supplement.
Figure 4B:
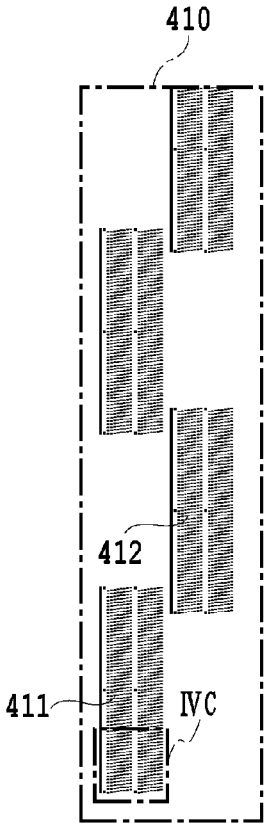
FIG. 4B is a diagram explaining a printing method of a test pattern of non-ejection supplement.
Figure 4C:
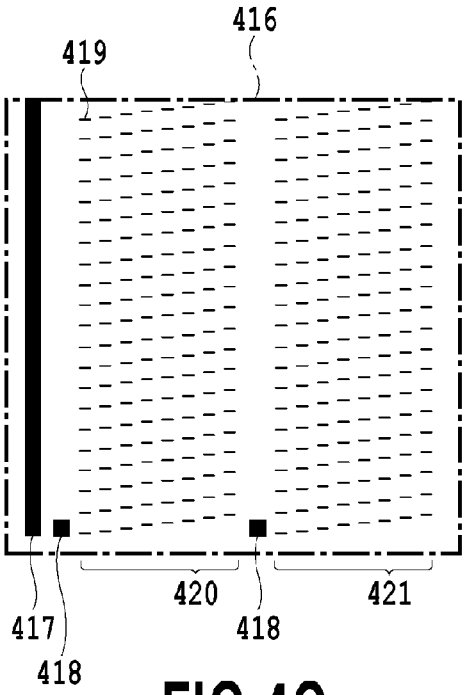
FIG. 4C is a diagram explaining a printing method of a test pattern of non-ejection supplement.
Figure 4D:
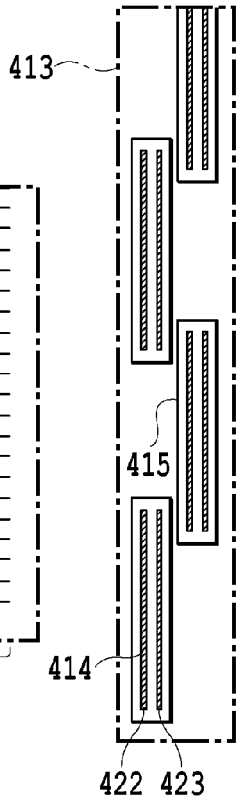
FIG. 4D is a diagram explaining a printing method of a test pattern of non-ejection supplement.

FIG. 3 is a diagram explaining a print head and a print head unit according to the present embodiment, a position of a scanner unit, a printing position of a test pattern, and non-ejection supplement. In addition, FIG. 3 shows an example of using a roll sheet as a print medium 304 for printing a test pattern 305 for non-ejection supplement on the print medium 304.

An arrow 306 shows a direction where the print medium 304 is conveyed. A direction of the arrow 306 is defined as a conveyance direction of the print medium 304. An arrow 307 shows an arrangement direction of nozzles in the print head. The direction of the arrow 307 is defined as a head main scan direction.

A print head unit 300 (print device) is equipped with a plurality of print heads and is constructed of seven print heads in the present embodiment. The respective print heads correspond to seven colors made up of K (black), M (magenta), C (cyan), Y (yellow), G (green), LM (light magenta), and LC (light cyan) in that order from the downstream in the conveyance direction of the print medium.

The arrows 301 and 302 directed in the head main scan directions show head main scan directions of the print head unit 300. A use nozzle region in the print head is controlled with the movement of the print head in the directions of the arrows 301 and 302. The use nozzle region is moved to use nozzles in a wide range of the print head for performing a printing operation, thus improving durability of the print head. In addition, the movement of the print head in the directions of the arrows 301 and 302 causes an adverse effect of variations in an ink ejection amount due to variations in a nozzle use amount to be reduced, thus reducing generation of a density step in a printing image.

The scanner unit 303 is arranged downstream of the print head unit 300 in the conveyance direction of the print medium. The scanner unit 303 reads out the test pattern 305 printed on the print medium 304 for detecting presence/absence of a defective ejection of the print head unit 300.

Here, the non-ejection supplement will be explained. When a non-ejection nozzle is present in the print head, ink is not ejected from that nozzle. Therefore, a white stripe is generated along the conveyance direction of the print medium on locations of the print medium where the ink is not hit, thus degrading an image quality of a printing image. The non-ejection supplement is a method in which, instead of the non-ejection nozzle, a different nozzle adjacent to the non-ejection nozzle in the nozzle line direction is used to perform a replacement ejection, thus reducing the white stripe of the printing image.

In the present embodiment, the print head of each color is equipped with two nozzle lines. In the non-ejection supplement, the replacement ejection is performed by a nozzle in a different nozzle line arranged in the same position with the non-ejection nozzle in the main scan direction. It should be noted that, in a case where the print head is equipped with nozzle lines more than the two nozzle lines or in a case where a plurality of print heads of the same color are provided, the non-ejection supplement may be carried out by replacement ejections using nozzles in a plurality of nozzle lines or by a replacement ejection using a nozzle in a different print head. In addition, for reducing an effect of the white stripe, the replacement ejection may be performed by a nozzle of a different color or by nozzles of plural colors.

FIGS. 4A to 4D are diagrams explaining the test pattern of the non-ejection supplement and a printing method of the test pattern according to the present embodiment, and shows an example of printing a test pattern 402 for the non-ejection supplement on a print medium 401 as a roll sheet. The test pattern 402 is a test pattern for carrying out non-ejection supplement of the print head unit 400. In the figure, an arrow α shows the conveyance direction of the print medium 401. Test patterns 403 to 409 are test patterns for detecting non-ejections corresponding to respective print heads. The test patterns 403 to 409 are test patterns corresponding to the respective print heads of K (black), M (magenta), C (cyan), Y (yellow), G (gray), LM (light magenta), and LC (light cyan). Each of the test patterns 403 to 409 is formed by printing the same test pattern by each of the corresponding print heads.

A test pattern 410 is a test pattern shown by enlarging a part of the test pattern 402. The print head in the present embodiment is constructed such that print chips each having a plurality of nozzles regularly line up in a staggered arrangement. In the test pattern, patterns 411 and 412 corresponding to the print chips constituting the print head respectively are printed in a staggered arrangement as shown in the figure. A print head 413 is a diagram shown by enlarging a part of the print head unit 400. Print chips 414 and 415 are print chips on which the patterns 411 and 412 corresponding to the respective print chips are printed.

A test pattern 416 is a diagram shown by enlarging a part of the test pattern 410. A construction and a printing method of the pattern corresponding to the print chip will be explained. The pattern corresponding to the print chip is constructed of a detection mark 417, alignment marks 418, and a non-ejection detection pattern 419. The detection mark 417 is a pattern for detecting a pattern corresponding to a print chip in a readout image. The detection mark 417 is a rectangular pattern by solid printing as shown in the figure.

In the present embodiment, the print chip is constructed of two nozzle lines as shown by nozzle lines 422 and 423. The detection mark 417 is printed by the droplet hitting of the two nozzle lines. Since a plurality of nozzle lines are used for printing, even in a case where the non-ejection nozzle is present, ink droplets are hit by a nozzle of the other nozzle line. Therefore, a defect of a detection pattern by the non-ejection nozzle can be reduced to stably detect the detection mark in the image analysis process.

The alignment mark 418 is a pattern which is a reference in an analysis region of the non-ejection detection pattern 419 in the image analysis process. The alignment mark 418 is a rectangular pattern by solid printing as shown in the figure, which is printed for each of non-ejection detection patterns 420 and 421 corresponding to the nozzle lines. The alignment mark 418 is printed by the droplet hitting of the nozzle line printing a non-ejection detection pattern region corresponding to the corresponding nozzle line.

The non-ejection detection pattern 419 is a pattern for detecting a defective ejection of a nozzle in the image analysis process. The non-ejection detection pattern 419 is a pattern formed in a segment configuration as shown in the figure, wherein the pattern formed in one segment configuration corresponds to one nozzle. The non-ejection detection pattern of the neighboring nozzle is printed to be shifted in printing timing to the print medium 401. By performing such control, the neighboring pattern is shifted in the conveyance direction of the print medium to prevent a pattern of the neighboring nozzle from overlapping the non-ejection detection pattern. When a distance from the pattern of the neighboring nozzle is set large, detection of the non-ejection detection pattern is facilitated in the image analysis process, and, further, even in a case where a printing position shift due to the defective ejection direction occurs, a possibility that the pattern of the neighboring nozzle overlaps the non-ejection detection pattern can be reduced.

Figure 5B:
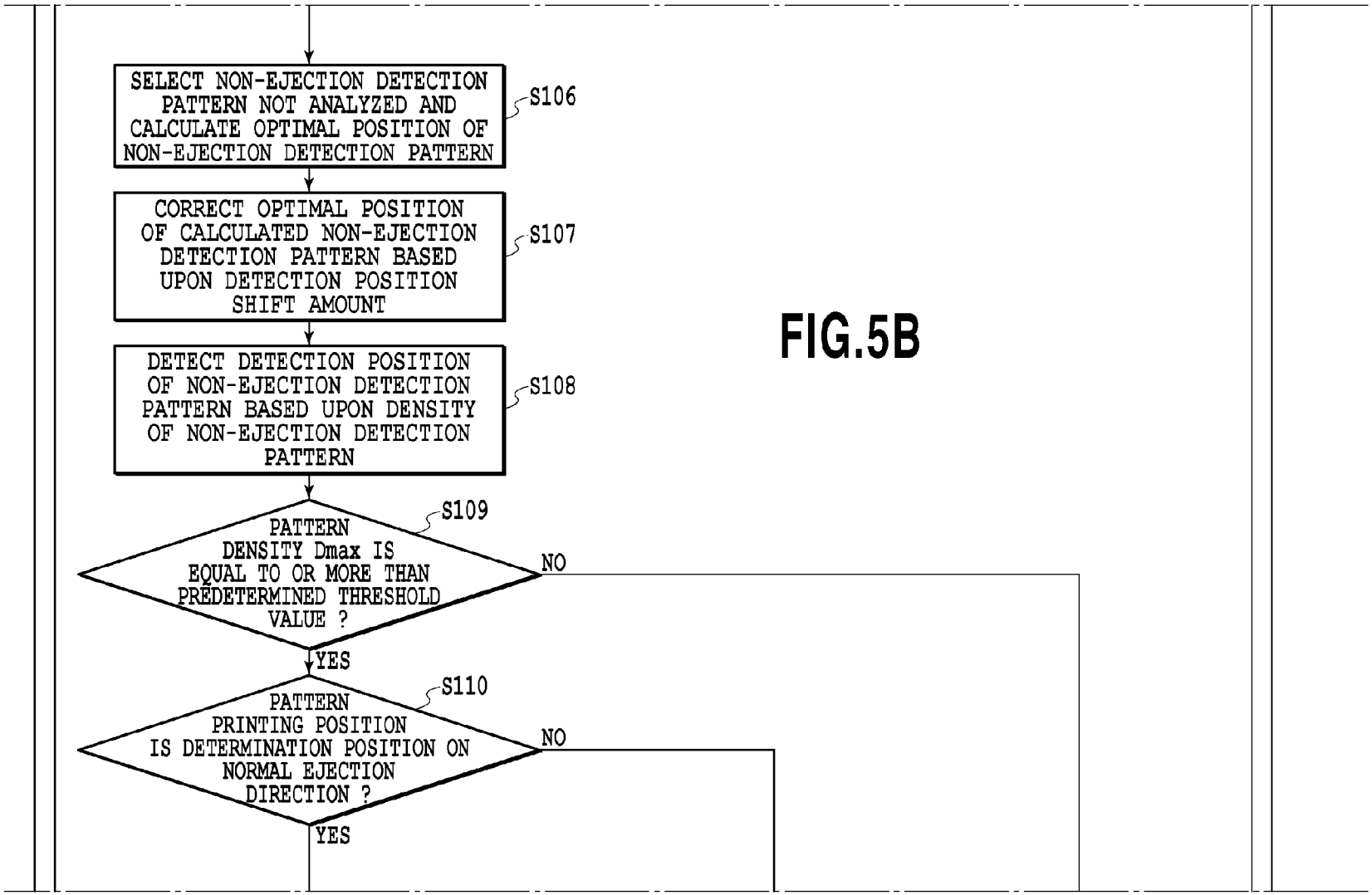
FIG. 5B is a flow chart explaining readout of the non-ejection supplement and the procedure of the analysis.
Figure 5C:
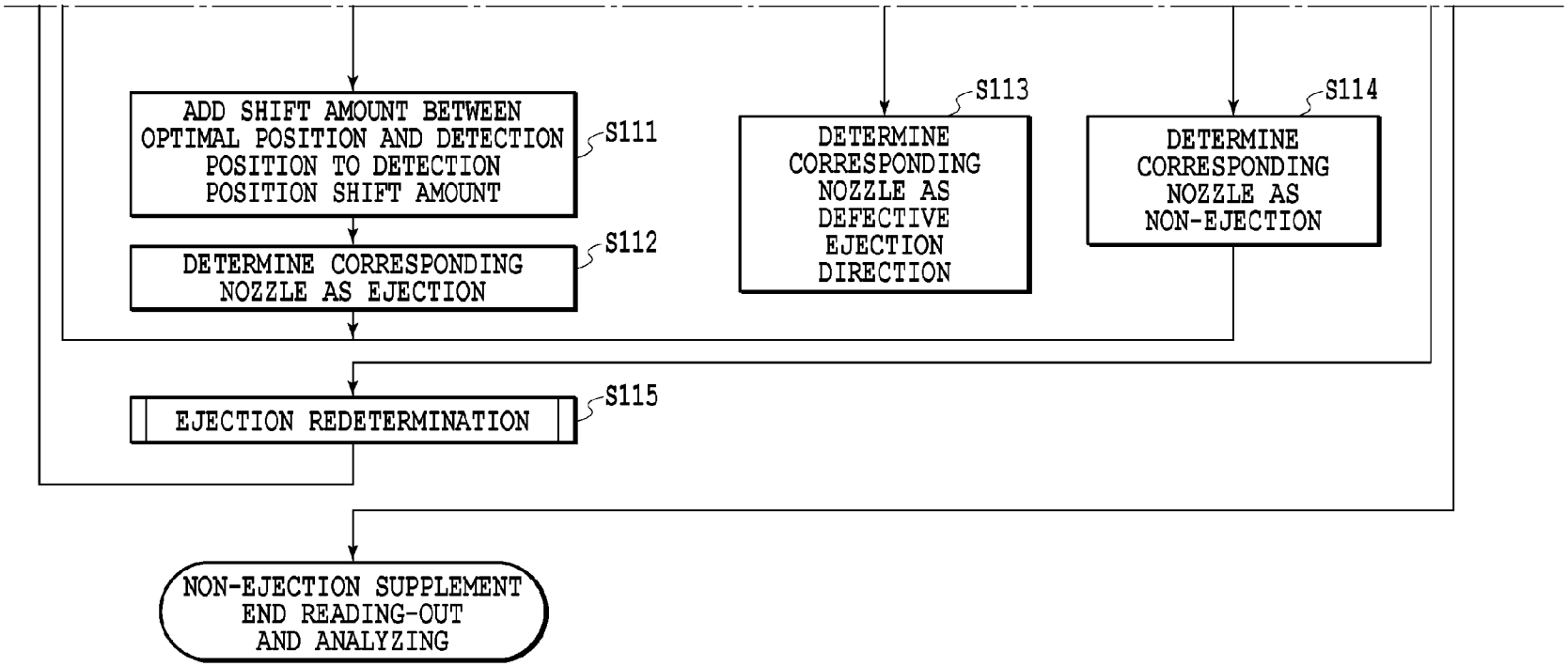
FIG. 5C is a flow chart explaining readout of the non-ejection supplement and the procedure of the analysis.

FIGS. 5A to 5C comprise a flow chart explaining reading-out of the non-ejection supplement and the procedure of the analysis according to the present embodiment. Hereinafter, the reading-out of the non-ejection supplement and each step of the procedure of the analysis will be explained along the flow chart.

In step S101, the scanner unit reads out a test pattern printed on the print medium. In regard to timing where the scanner unit starts the reading-out of the test pattern, the reading-out may start after a predetermined time elapses from pattern printing start timing or after the print medium is conveyed by a predetermined amount from pattern printing completion timing. In regard to the timing of completing the reading, the reading-out is completed by reading out a predetermined number of sub scan lines from the reading start.

Thereafter, in step S102, the scanner control unit detects a pattern corresponding to each print chip in the print head from the readout image of the test pattern read in step S101. The process of detecting the pattern corresponding to each print chip will be in detail described in the explanation in FIGS. 7A to 7E. Next, in step S103, the scanner control unit determines whether or not analysis on the non-ejection supplement processes of patterns corresponding to all the print chips detected in step S102 is made. In a case where the analysis on all the patterns is made, the process ends.

In a case where the analysis of not all the patterns is made, the process goes to next step S104. In step S104, the scanner control unit selects a pattern corresponding to the print chip not subjected to the analysis and performs a detection process of an alignment mark of the selected pattern. The detection process of the alignment mark will be in detail described in the explanation in FIGS. 7A to 7E. The process goes to step S105, wherein the scanner control unit determines whether or not the analysis on all the non-ejection detection patterns in the patterns corresponding to the selected print chips is made. In a case where the analysis on all the non-ejection detection patterns is made, the process goes to step S115, wherein an ejection redetermination process to be described later is performed. In a case where the analysis of not all the non-ejection detection patterns is made, the process goes to step S106.

In step S106, the scanner control unit selects a non-ejection detection pattern not subjected to the analysis and calculates an optimal position (theoretical position) of the selected non-ejection detection pattern based upon the alignment mark position detected in step S104. The optimal position of the non-ejection detection pattern is a position found by calculating a position where the non-ejection detection pattern is printed on the readout image, based upon information of a dimension where the non-ejection detection pattern is printed, on a basis of the position of the alignment mark. The optimal position of the non-ejection detection pattern will be in detail described in the explanation in FIGS. 10A to 10D.

Next, the process goes to step S107, wherein the scanner control unit (correcting device) corrects the optimal position of the non-ejection detection pattern calculated in step S106, based upon a detection position shift amount to be described later. The detection position shift amount is a value for correcting the optimal position of the non-ejection detection pattern to find a more accurate printing position of the non-ejection detection pattern. The detection position shift amount (correction amount) is initialized to zero for each of the selected print chips, a value of which is updated in step S111 to be described later.

Since the detection position shift amount is a shift amount between an optimal position of the analyzed non-ejection detection pattern and a detection position of the non-ejection detection pattern, calculation of the correction is made according to the formula of "optimal position of non-ejection detection pattern after correction"="optimal position of non-ejection detection pattern"−"detection position shift amount". Thereafter, in step S108, the scanner control unit analyzes the non-ejection detection pattern based upon the optimal position of the non-ejection detection pattern calculated in step S106 and detects a detection position of the non-ejection detection pattern based upon a density of the non-ejection detection pattern. The process of detecting the detection position of the non-ejection detection pattern will be in detail described in the explanation in FIGS. 8A to 8E to be described later.

In step S109, the scanner control unit determines whether or not a value of a pattern density Dmax (maximum density value) of the pattern detection position detected in step S108 is equal to or more than a predetermined threshold value. In a case where the pattern density Dmax is smaller than the predetermined threshold value, in step S114, the detected non-ejection detection pattern is determined as non-ejection to perform the process of determining a nozzle corresponding to the pattern as non-ejection. The nozzle determined as the non-ejection is a nozzle subjected to non-ejection supplement control in printing a practical image. The pattern density Dmax and the predetermined threshold value will be in detail described in the explanation in FIGS. 8A to 8E.

In addition, in a case where the pattern density Dmax is more than the predetermined threshold value, the process goes to step S110, wherein the scanner control unit determines whether or not the pattern detection position detected in step S108 is a determination position on the normal ejection direction. Here, the determination position on the normal ejection direction is a position for determining whether or not the nozzle has a defective ejection direction from the pattern detection position, and a position within a predetermined amount from the pattern optimal position. The process of determining whether or not the pattern detection position is the determination position on the normal ejection direction will be in detail described in the explanation in FIGS. 8A to 8E. In a case where in step S110, it is determined that the pattern printing position is not the determination position on the normal ejection direction, the process goes to step S113, wherein the nozzle is determined as a defective ejection direction.

The nozzle of which the ejection direction is defective is defined as a nozzle to which the non-ejection supplement control is performed upon printing a practical image. In a case where the pattern printing position is determined as the determination position on the normal ejection direction, the process goes to step S111.

In step S111, the scanner control unit adds a shift amount between the pattern optimal position and the pattern detection position to the detection position shift amount. The process of adding the shift amount between the pattern optimal position and the pattern detection position to the detection position shift amount will be in detail described in the explanation in FIGS. 10A to 10D to be described later. Thereafter, the process goes to step S112, wherein the scanner control unit determines the non-ejection detection pattern as ejection to determine a nozzle corresponding to the pattern as ejection.

In step S115, the scanner control unit performs an ejection redetermination process of a pattern corresponding to the selected print chip. The ejection redetermination process is a process of re-determining the ejection determination of the nozzle and the non-ejection determination of the nozzle determined in step S112 and step S113, based upon the pattern density Dmax and the density in the sheet white region of the pattern which are detected in the pattern analysis corresponding to the print chip. The ejection redetermination process will be in detail described in the explanation in FIG. 6 to be described later.

Figure 6:
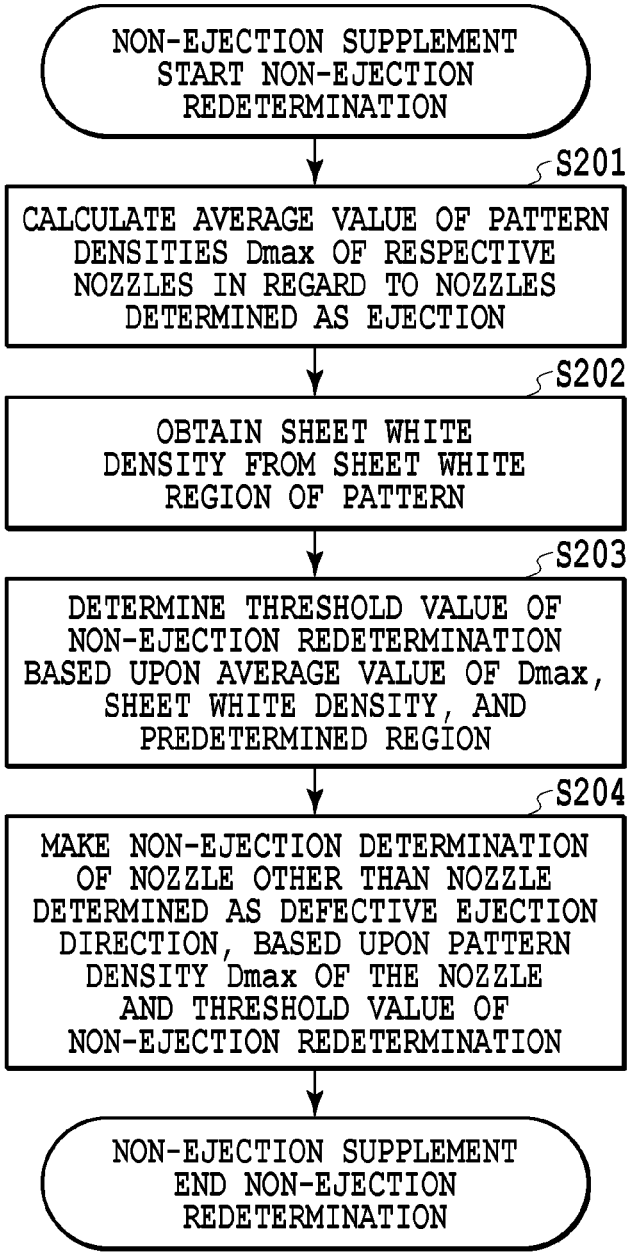
FIG. 6 is a flow chart explaining the ejection redetermination process in FIGS. 5A to 5C.

FIG. 6 shows the details of the process in step S115 in FIG. 5C and is a flow chart explaining the procedure of the non-ejection redetermination process of the non-ejection supplement. The ejection redetermination process is a process of re-determining the ejection determination of the nozzle and the non-ejection determination of the nozzle determined in step S112 and step S114, based upon the pattern density Dmax and the density in the sheet white region of the pattern which are detected in the non-ejection detection pattern analysis process. Since the ejection redetermination process makes an ejection determination based upon the density of the non-ejection detection pattern in the readout image, a more accurate ejection determination can be made than the detection method based upon the predetermined threshold value to be performed in step S109 in FIG. 5B.

When the process for making the non-ejection redetermination in the non-ejection supplement is started, in step S201 the scanner control unit calculates an average value of pattern densities Dmax of all the nozzles in regard to the nozzles determined as ejection in step S112 in FIG. 5C. Thereafter, in step S202 the scanner control unit obtains a sheet white density from a sheet white region in the pattern periphery corresponding to the print chip. The process goes to step S203, wherein the scanner control unit calculates an ejection redetermination threshold value based upon the average value of the pattern densities Dmax, the sheet white density, and a predetermined rate. The ejection redetermination threshold value is calculated according to the calculation formula of "ejection redetermination threshold value"="sheet white density"+"(Dmax average value−sheet white density)×a predetermined rate".

When the threshold value is determined, in step S204 the scanner control unit performs a re-ejection determination in regard to the nozzle determined as ejection or the nozzle as non-ejection in step S112 or step S114 in FIG. 5C, based upon the pattern density Dmax of the nozzle and the ejection redetermination threshold value. When the pattern density Dmax is equal to or more than the ejection redetermination threshold value, the nozzle is determined as ejection, and when the pattern density Dmax is smaller than the ejection redetermination threshold value, the nozzle is determined as non-ejection. The nozzle determined as non-ejection is defined as a nozzle to be subjected to non-ejection supplement control upon printing a practical image. The nozzle determined as ejection is defined as a nozzle to be not subjected to non-ejection supplement control.

FIGS. 7A to 7E are diagrams explaining a process of detecting a detection mark and a process of detecting an alignment mark of a pattern corresponding to a print chip from a readout image of a test pattern of non-ejection supplement according to the present embodiment. A pattern 700 corresponding to the print chip illustrates a part of the readout image of the test pattern, and is a pattern corresponding to one print chip. The detection mark 701 is a pattern for detecting the pattern 700 corresponding to the print chip in the readout image. The alignment mark 702 is a pattern used as a reference of an analysis region in a non-ejection detection pattern.

The process of detecting the pattern corresponding to the print chip and the process of detecting the alignment mark which are described in step S102 and step S104 in FIG. 5A described before will be explained. Each detection process uses an image of a channel in which the density in printing colors of the print head of the pattern as a detection target is the highest, among three channels RGB in the readout image. For example, in a case of C (cyan), an image of R channel is used, in a case of M (magenta), an image of G channel is used, and in a case of Y (yellow), an image of B channel is used. It should be noted that, in a case of the printing color where the density is high in all the channels, such as in the case of K (black), G channel is used in the present embodiment. Test patterns 703, 704, 705, and 706 are diagrams shown by enlarging a part of the detection mark 701 and the alignment mark 702.

The process of detecting the pattern corresponding to the print chip is performed by detecting the detection mark 701 from the readout image. The process of detecting the detection mark 701 will be explained. The detection of the detection mark 701 is made based upon an average density in a predetermined region of the readout image. A detection mark detection region 707 is a region for obtaining an average density, and in a case where the average density is a predetermined density or more, the region is determined as a region of the detection mark 701 to indicate a center position of the detection mark detection region 707 as a detection mark detection position 708. Next, a top left end position 709 of the detection mark 701 and a top right end 710 of the detection mark 701 are detected. A region having the predetermined density or more from the detection mark detection position 708 is scanned, and a top left end in the region having the predetermined density or more is set as the top left end position 709 of the detection mark 701. Likewise, a top right end in the region having the predetermined density or more is set as the top right end position 710 of the detection mark 701.

Next, the process of detecting the alignment mark 702 will be explained. The detection of the alignment mark 702 is made by calculating a position of the detected detection mark 701 and a density gravity center in the predetermined region. Three pieces of the alignment marks are printed in the left end, the center, and the right end in each pattern of each nozzle line. First, detection of the alignment mark in the left end is made. The detection of the alignment mark in the left end is made by calculating a density gravity center in a predetermined region 712 on a basis of a predetermined position 711 determined based upon the top left end position 709 of the detection mark already detected.

The density gravity center in the predetermined region 712 corresponds to the center position of the alignment mark. A left end alignment mark position 713 as result of calculating the density gravity center is shown in the figure. Next, detection of the alignment mark in the right end is made. The detection of the alignment mark in the right end is made by calculating a density gravity center in a predetermined region 715 on a basis of a predetermined position 714 determined based upon the top right end position 710 of the detection mark already detected. A right end alignment mark position 716 as result of calculating the density gravity center is shown in the figure.

Next, detection of the alignment mark in the center is made. The detection of the alignment mark in the center is made by calculating a density gravity center in a predetermined region 718 on a basis of a predetermined position 717 determined based upon the alignment mark position 713 in the left end and a predetermined position 717 determined based upon an intermediate position of the alignment mark 716 in the right end. A center alignment mark position 719 as result of calculating the density gravity center is shown in the figure.

FIGS. 8A to 8E are diagrams explaining a process of analyzing a non-ejection detection pattern to determine an ejection state of a nozzle according to the present embodiment. The process of analyzing a test pattern 800 of non-ejection supplement in the readout image to determine whether the nozzle is in an ejection state, in a defective ejection direction state or in a non-ejection state will be explained. A test pattern 802 is a diagram shown by enlarging a part of a test pattern 801 corresponding to a print chip.

Non-ejection detection pattern analysis regions 803, 804 and 805 show analysis regions of a non-ejection detection pattern, and each of the non-ejection detection pattern analysis regions corresponds to a non-ejection detection pattern for each one nozzle. A method of determining a position of the analysis region in the non-ejection detection pattern will be in detail described in the explanation in FIGS. 10A to 10D. In regard to a dimension of the analysis region in the non-ejection detection pattern, a dimension thereof in the print head main scan direction is equal to an interval between a neighboring non-ejection detection pattern and the non-ejection detection pattern in the right-left direction in the figure, a dimension thereof in the print medium conveyance direction is equal to a length of the printed non-ejection detection pattern.

Density analysis results 806, 807 and 808 of the analysis regions are shown by graphs of density values in the analysis processes of the non-ejection detection pattern analysis regions 803, 804 and 805. Each density value is a value found by averaging density values of pixels of the non-ejection detection pattern analysis regions in the print medium conveyance direction. A lateral axis 809 in each graph shows a pixel position in the print head main scan direction, and a vertical axis 810 shows a density value of each pixel. An ejection determination threshold value 811 is a threshold value to a density value for determining an ejection state. In a case where a pattern density Dmax as the maximum value of the density values in the non-ejection detection pattern analysis region is equal to or more than the ejection determination threshold value 811, the non-ejection detection pattern is determined as an ejection state. In a case where the pattern density Dmax is smaller than the ejection threshold value 811, the non-ejection detection pattern is determined as a non-ejection state.

A determination position 812 on the normal ejection direction shows a state where the nozzle in the non-ejection detection pattern is in an ejection state, but an ejection direction of ink ejected from the nozzle is inclined and a droplet-hitting position on the print medium is shifted, that is, a pixel position where the nozzle is determined to be in a defective ejection direction. The determination positions 812 on the normal ejection direction have, as shown in the figure, two locations positioned in a plus (right) direction and a minus (left) direction from a center pixel position in the non-ejection detection pattern analysis region, wherein the center pixel position direction from the two positions is defined as inside and the center pixel position opposing direction from the two positions is defined as outside. In regard to determination of a defective ejection direction, in a case where the pattern density Dmax is the ejection determination threshold value 811 or more and a pixel position of the pattern density Dmax is inside of the determination position 812 on the normal ejection direction, the ejection direction is determined as normal and in a case where the pattern density Dmax is the ejection determination threshold value 811 or more and the pixel position of the pattern density Dmax is outside of the determination position 812 on the normal ejection direction, the ejection direction is determined as defective.

Determination on an ejection state of the density analysis result 806 in the analysis region is made as ejection since the pattern density Dmax as the maximum value of the density values in the non-ejection detection pattern analysis region is the ejection determination threshold value 811 or more and the pixel position of the pattern density Dmax is inside of the determination position 812 on the normal ejection direction. Determination on an ejection state of the density analysis result 807 in the analysis region is made as non-ejection since the pattern density Dmax as the maximum value of the density values in the non-ejection detection pattern analysis region is smaller than the ejection determination threshold value 811. Further, determination on an ejection state of the density analysis result 808 in the analysis region is made as a defective ejection direction since the pattern density Dmax as the maximum value of the density values in the non-ejection detection pattern analysis region is the ejection determination threshold value 811 or more and the pixel position of the pattern density Dmax is outside of the determination position 812 on the normal ejection direction.

Figure 9B:
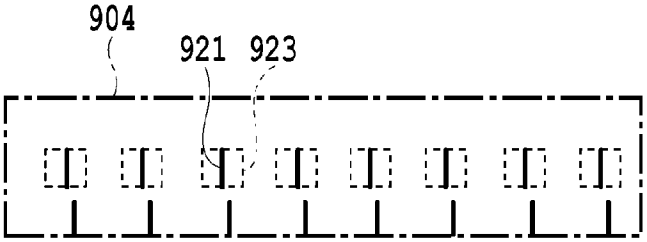
FIG. 9B is a diagram explaining an effect of an image distortion in the readout image of the test pattern.
Figure 9C:
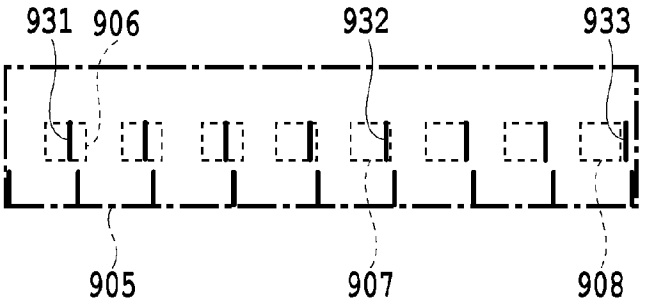
FIG. 9C is a diagram explaining an effect of an image distortion in the readout image of the test pattern.
Figure 9A:
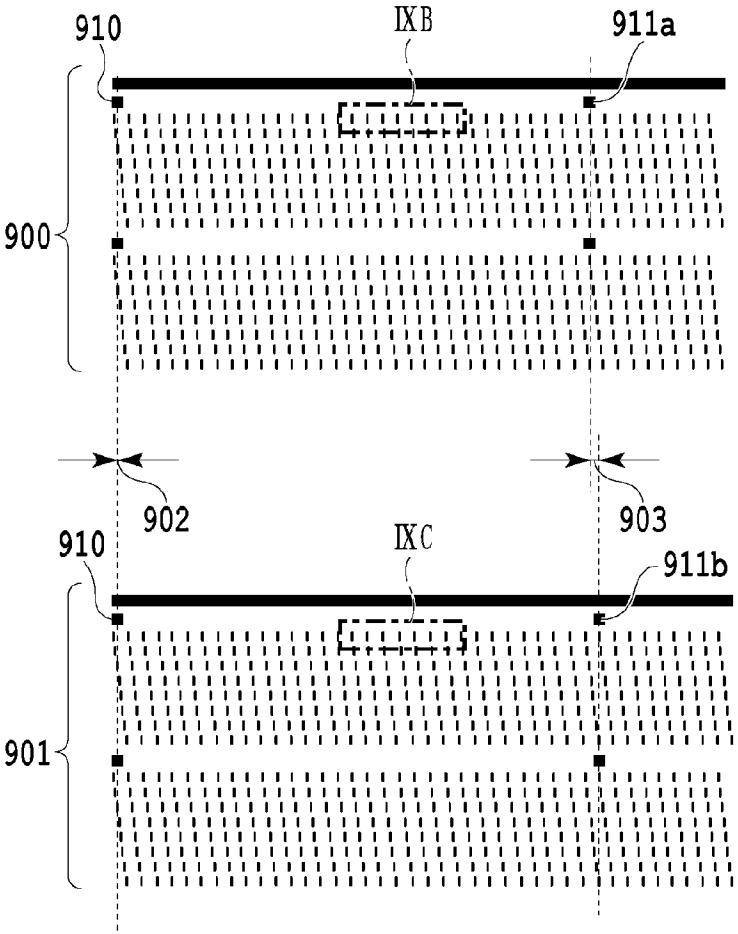
FIG. 9A is a diagram explaining an effect of an image distortion in the readout image of the test pattern.

FIGS. 9A to 9C are diagrams explaining an effect of an image distortion in the readout image of the test pattern of the non-ejection detection. In the present embodiment, positions of analysis regions of each non-ejection detection pattern are corrected by a method to be explained in FIGS. 10A to 10D to be described later, and here, an effect in a case where the correction is not applied will be explained. The image distortion described herein is caused by an optical aberration of a scanner reading out the test pattern of the non-ejection detection, and shows a partial magnification aberration in the main scan direction. A test pattern 900 for the non-ejection detection shows a readout image (image on image data generated by the reading-out) of a non-ejection detection test pattern in a case of assuming that the image distortion caused by the optical aberration of the scanner is not generated. A test pattern 901 for the non-ejection detection shows a readout image of a non-ejection detection test pattern in a case of assuming that the image distortion caused by the optical aberration of the scanner is generated.

The image distortion is the partial magnification aberration in the main scan direction, and a case where the partial magnification is, as shown in the figure, higher as compares to a case where the image distortion is not generated will be explained. It should be noted that in the present embodiment, a case where the partial magnification is higher will be explained, but there is a case where it is smaller or it is higher or smaller in a pattern corresponding to the print chip. In a case where the partial magnification is high, one alignment mark 910 in the left end is, as shown in the figure, set as a reference and the position 902 is assumed to have no shift. A position of another alignment mark 911*b* in the test pattern 901 causes a position shift 903 to an alignment mark 911*a* in the pattern 900 having no image distortion.

Here, an explanation will be made on a precondition that the non-ejection detection pattern printed on the print medium is formed in an optimal position printed without any defective ejection or any defective ejection direction by a nozzle arranged in an optimal position on a design. A non-ejection detection pattern region 904 is shown by enlarging a part of the readout image in the test pattern 900 for the non-ejection detection. An analysis region 923 of the non-ejection detection pattern is arranged in a position calculated based upon an optimal position of the non-ejection detection pattern.

Since the non-ejection detection pattern region 904 has no image distortion, each non-ejection detection pattern 921 formed in an optimal position as shown in the figure is positioned to be not shifted from the center of the analysis region 923 of the non-ejection detection pattern corresponding to the pattern 921. A non-ejection detection pattern region 905 is shown by enlarging a part of the readout image in the test pattern 901 for the non-ejection detection. Since the non-ejection detection pattern region 905 has an image distortion as shown in the figure, as it is more remote from the alignment mark in the left side, non-ejection detection patterns 931, 932 and 933 are shifted in position the more to analysis regions 906, 907 and 908 of the non-ejection detection pattern.

That is, even if the test pattern for the non-ejection detection pattern is normally printed in an optimal position on the print medium, a position of the non-ejection detection pattern is shifted from the center in the analysis region set on a precondition of an optimal position due to a distortion by a aberration in the readout image by the scanner, and there is a possibility that an incorrect determination is made, such as the defective ejection direction determination 906 or the non-ejection determination 907. Therefore, by shifting (correcting) the position of the analysis region by a distance corresponding to the position shift due to the aberration of the non-ejection detection pattern, the analysis of the non-ejection detection pattern on the read image can be accurately performed.

FIGS. 10A to 10D are diagrams explaining a process of determining a position of an analysis region of a non-ejection detection pattern in a readout image (image data).

Numeral 1001 shows a position of a non-ejection detection pattern 1102 and a position of an analysis region 1103 in an actual readout image (image data). The analysis region is arranged to be calculated in such a manner that the center is in agreement with a position of the non-ejection detection pattern ejected in an optimal position. A position of the analysis region 1103 is calculated based upon a dimension of the printed test pattern by using the alignment mark in the left side as a reference. Since the readout image has an image distortion, the calculated position of the analysis region 1103 is, as shown in the figure, shifted from the position of the non-ejection detection pattern on the readout image. Therefore, the position of each analysis region is corrected to a position corresponding to the image distortion.

Numeral 1002 shows a diagram of correcting the position of the analysis region based upon a position shift amount of the non-ejection detection pattern on the readout image. FIGS. 11A to 11E are diagrams showing non-ejection detection patterns for explaining the procedure of the correction of the analysis region.

Figure 10A:
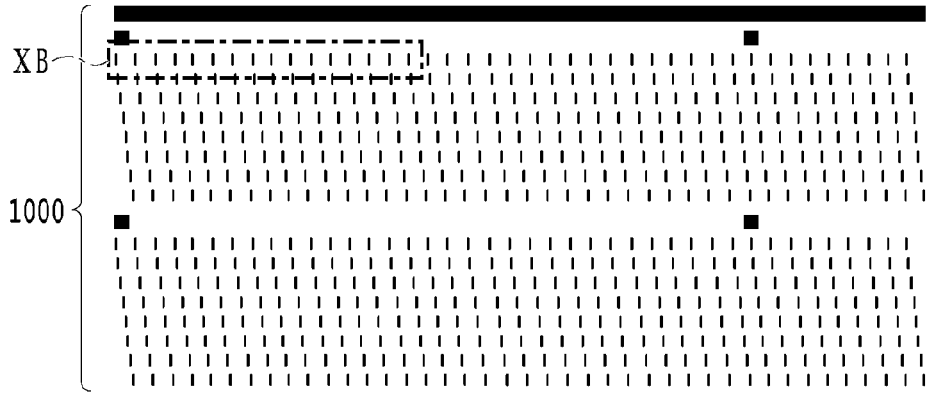
FIG. 10A is a diagram explaining detection of an optimal position of a non-ejection detection pattern and a detection position shift amount.
Figure 10B:
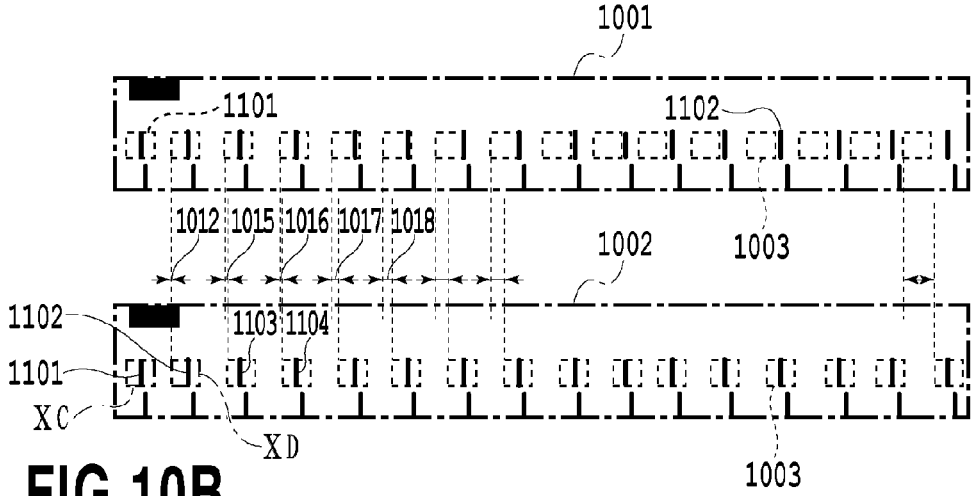
FIG. 10B is a diagram explaining detection of an optimal position of a non-ejection detection pattern and a detection position shift amount.
Figure 10C:
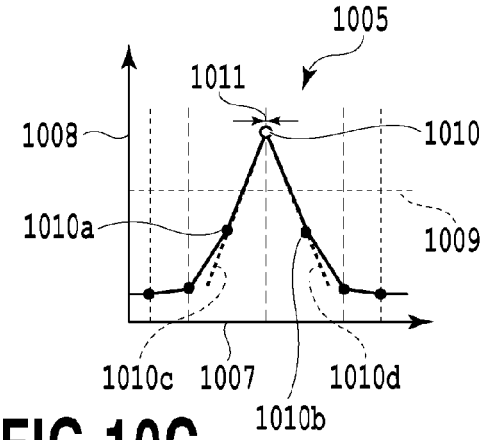
FIG. 10C is a diagram explaining detection of an optimal position of a non-ejection detection pattern and a detection position shift amount.
Figure 10D:
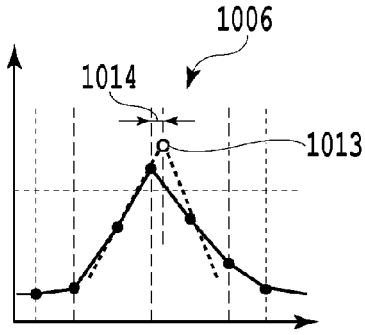
FIG. 10D is a diagram explaining detection of an optimal position of a non-ejection detection pattern and a detection position shift amount.

In the present embodiment, the analysis of the non-ejection detection pattern is performed in the order from the non-ejection detection pattern in the left end to the non-ejection detection pattern in the right end among the non-ejection detection patterns lining up in the head main scan direction (right-left direction in FIG. 10A). When the analysis to the non-ejection detection pattern in the right end is completed, the analysis is likewise performed from the lower non-ejection detection pattern in the left end. It should be noted that the analysis of the non-ejection detection pattern may be performed in any order as long as it is performed in the order of scanning the neighboring non-ejection detection pattern, for example, the analysis is performed in the order from the non-ejection detection pattern in the top end to the left end and next, the similar analysis is performed from the non-ejection detection pattern in the top end in the right side.

Figure 11A:
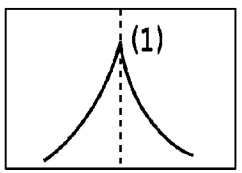
FIG. 11A is a diagram showing the non-ejection detection pattern.

First, a density analysis of the nearest non-ejection detection pattern 1101 to the left alignment mark on the readout image is performed to perform a position correction process of the non-ejection detection pattern. FIG. 11A shows a graph of a density distribution at the time of reading out the non-ejection detection pattern 1101 by a scanner. A width of the square is equal to a width of the analysis region. A vertical dotted line (1) in the center (hereinafter, called an optimal position line) shows an optimal position of the non-ejection detection pattern. An analysis for enhancing accuracy of the graph for the density distribution will be explained later. Since the nearest non-ejection detection pattern 1101 to the left alignment mark has no shift due to the aberration, the position of the analysis region is not corrected.

Figure 11B:
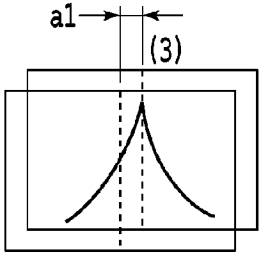
FIG. 11B is a diagram showing the non-ejection detection pattern.

Next, a position of the analysis region for a non-ejection detection pattern 1102 adjacent in the right to the non-ejection detection pattern 1101 is corrected. The correction is made by two steps of primary correction and secondary correction. In FIG. 11B, the optimal position line (1) is in agreement with an optimal position of the non-ejection detection pattern 1102. In the primary correction, a position of the optimal position line is corrected by the same as the analysis region of the non-ejection detection pattern 1101 adjacent in the left thereto, and at the same time, a position of the analysis region of the non-ejection detection pattern 1102 is also corrected by the same amount.

Since the position of the analysis region in the non-ejection detection pattern 1101 is not corrected at this time, an optimal position line (2) after the primary correction is in agreement with the optimal position line (1). In the next secondary correction, a shift direction and a shift distance a1 of a peak of a density distribution curve of the non-ejection detection pattern 1102 from the optimal position line (2) after the primary correction are found.

When the position of the optimal position line (2) after the primary correction is shifted by the distance a1 in the shift direction (right direction in the figure), a final optimal position line (3) can be obtained. The analysis region is also shifted by the same distance a1 in the same direction. The analysis region after the secondary correction is a final analysis region to the non-ejection detection pattern 1102. It should be noted that the square of the analysis region is shifted upward and downward for visibility in FIG. 11B to FIG. 11E, but it is not actually shifted.

Figure 11C:
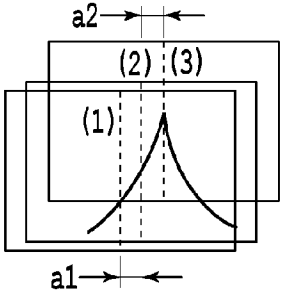
FIG. 11C is a diagram showing the non-ejection detection pattern.

Next, an analysis region in a non-ejection detection pattern 1103 adjacent in the right to the non-ejection detection pattern 1102 is corrected in position. In FIG. 11C, an optimal position line (1) of the non-ejection detection pattern 1103 is shifted as the primary correction by the same distance with the distance a1 for the optimal position line of the non-ejection detection pattern 1102 to be shifted from the optimal position to find an optimal position line (2) after the primary correction, shifting the analysis region of the non-ejection detection pattern 1103 likewise. In the next secondary correction, a shift direction and a shift distance a2 of a peak of a density distribution curve of the non-ejection detection pattern 1103 from the optimal position line (2) after the primary correction are found. When the position of the optimal position line (2) after the primary correction is shifted by the distance a2 in the shift direction (right direction in the figure), a final optimal position line (3) can be obtained. The analysis region is also shifted by the same distance a2 in the same direction to obtain a final analysis region.

Figure 11D:
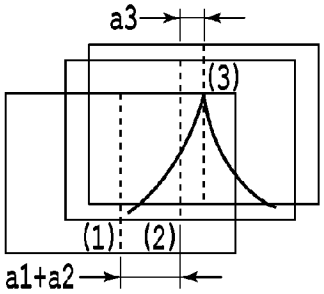
FIG. 11D is a diagram showing the non-ejection detection pattern.

Further, an analysis region in a non-ejection detection pattern 1104 adjacent in the right to the non-ejection detection pattern 1103 is corrected in position. In FIG. 11D, an optimal position line (1) of the non-ejection detection pattern 1104 is shifted as the primary correction by the same distance with the distance a1+a2 for the optimal position line of the non-ejection detection pattern 1103 to be shifted from the optimal position to find an optimal position line (2) after the primary correction, shifting the analysis region of the non-ejection detection pattern 1104 likewise. In the next secondary correction, a shift direction and a shift distance a3 of a peak of a density distribution curve of the non-ejection detection pattern 1104 from the optimal position line (2) after the primary correction are found. When the position of the optimal position line (2) after the primary correction is shifted by the distance a3 in the shift direction (right direction in the figure), a final optimal position line (3) can be obtained. The analysis region is also shifted by the same distance a3 in the same direction to obtain a final analysis region.

Figure 11E:
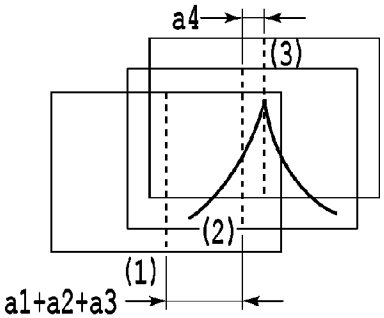
FIG. 11E is a diagram showing the non-ejection detection pattern.

Next, a position of an analysis region in a non-ejection detection pattern 1105 adjacent in the right to the non-ejection detection pattern 1104 is likewise corrected. In FIG. 11E, an optimal position line (1) of the non-ejection detection pattern 1105 is shifted by the same distance with a distance a1+a2+a3 for the optimal position line of the non-ejection detection pattern 1104 to be shifted from the optimal position to find an optimal position line (2) after the primary correction, and the analysis region is also shifted likewise.

In the next secondary correction, a shift direction and a shift distance a4 of a peak of a density distribution curve of the non-ejection detection pattern 1105 from the optimal position line (2) after the primary correction are found. When the position of the optimal position line (2) after the primary correction is shifted by the distance a4 in the shift direction (right direction in the figure), a final optimal position line (3) can be obtained. The analysis region is also shifted by the same distance a4 in the same direction to obtain a final analysis region.

In this manner, the position of each analysis region can be sequentially corrected by repeating the primary correction of shifting the each analysis region by the same amount with the distance by which the analysis region of the non-ejection detection pattern adjacent in the left thereto is shifted from the optimal position and the secondary correction of shifting the optimal position line after the primary correction in such a manner as to be in agreement with the peak of the density distribution curve.

In a case where the peak of the density distribution curve does not exist within the analysis region after the primary correction due to the defective ejection or the defective ejection direction, the secondary correction is omitted and the analysis region after the primary correction is used as a final analysis region. Alternatively also in a case where the peak of the density distribution curve exists outside of the determination position 812 on the normal ejection direction explained in FIGS. 8A to 8E in the analysis region after the primary correction, the secondary correction may be omitted.

Next, a density analysis of the non-ejection detection pattern read out by the scanner will be explained. The density analysis is the process of detecting a position of the non-ejection detection pattern with higher accuracy than a resolution of the scanner. With this process, the position of the non-ejection detection pattern can be detected with, not the position accuracy of a pixel order of one pixel unit of the scanner, but the position accuracy of a sub pixel order of a higher resolution capability smaller than one pixel unit. In regard to the density analysis result 1005 of the analysis region, density values in the analysis process of the non-ejection detection pattern are shown in the graph. Each density value is a value found by averaging density values of pixels in the non-ejection detection pattern analysis region in the print medium conveyance direction. A lateral axis 1007 shows a pixel position in the print head main scan direction and a vertical axis 1008 shows a density value in each pixel. An ejection determination threshold value 1009 is a threshold value to a density value for determining an ejection state.

Next, analysis of the non-ejection detection pattern 1102 adjacent to the non-ejection detection pattern 1101 is performed. A density analysis result 1006 of the analysis region is shown in a graph of density values in the analysis process of the non-ejection detection pattern 1102, and is shown in the graph similar to that of the density analysis result 1005 of the analysis region. The density analysis result 1006 of the analysis region is an analysis region density analysis result in the non-ejection detection pattern analysis to be performed following the density analysis result 1005 of the analysis region in an analysis process of a test pattern 1000 of the non-ejection detection.

Here, the correction of the position in the analysis region of the non-ejection detection pattern will be specially explained. First, for initializing a position shift amount of the analysis region for each print chip, the position shift amount is made to zero. Next, a position of the analysis region is calculated. The position of the analysis region is calculated based upon the alignment mark position and information on a dimension of the printed test pattern. An optimal position of each non-ejection detection pattern is shown in the non-ejection detection pattern region 1001.

First, a position of the first analysis region in the non-ejection detection pattern region 1001 is calculated. Next, the calculated position of the analysis region is corrected. Since the first analysis region has no shift, the shift amount is zero. Accordingly, the position of the analysis region after correction is the same as the calculated position.

Next, a position of the non-ejection detection pattern is detected based upon the density analysis result of the analysis region. In the present embodiment, the position of the non-ejection detection pattern is detected based upon a density plot 1010 of a pixel in which the maximum density is detected and density plots 1010*a* and 1010*b* of two pixels around the pixel. Among a straight line 1010*c* passing in the vicinity of the plot 1010 and the plot 1010*a* and a straight line 1010*d* passing in the vicinity of the plot 1010 and the plot 1010*b*, a crossing point between straight lines each having the same angle to the vertical axis 1008 and a smallest sum of distances to the near plots from each straight line is found. A position of the crossing point is the position of the non-ejection detection pattern. The detection position 1010 of the non-ejection detection pattern shows a detection position of the on-ejection detection pattern detected from the density analysis result 1005 of the analysis region.

Next, the shift amount between the optimal position and the detection position in the non-ejection detection pattern is added to the detection position shift amount. The optimal position of the non-ejection detection pattern is a central pixel position in the density analysis result 1005 of the analysis region. A shift amount 1011 between the optimal position of the non-ejection detection pattern and the detection position of the non-ejection detection pattern detected before is zero. Therefore, the detection position shift amount is zero as it is.

Next, analysis of the non-ejection detection pattern adjacent in the right to the non-ejection detection pattern having been presently analyzed is performed. Since the detection position shift amount is herein zero as it is, the correction of the optimal position in the non-ejection detection pattern is not substantially made. Next, the shift amount between the optimal position and the detection position in the non-ejection detection pattern found based upon the density analysis result of the analysis region is added to the detection position shift amount. A shift amount 1014 (difference amount) between the optimal position of the non-ejection detection pattern and a detection position 1013 of the non-ejection detection pattern is added to the detection position shift amount.

The detection position shift amount 1015 shows a detection position shift amount herein. The detection position shift amount 1015 is a value subtracted from the optimal position of the non-ejection detection pattern in correcting the optimal position of the non-ejection detection pattern to be analyzed next.

In this manner, the optimal position is corrected by subtracting the detection position shift amount from the optimal position of the non-ejection detection pattern, and by detecting the detection position of the non-ejection detection pattern, the shift amount between the optimal position and the detection position is added to the detection position shift amount. With this process, the optimal position can be corrected.

In this manner, there can be provided the technology in which even in a case where the image distortion is generated in the image as a result of reading out the test pattern by the reading device, the analysis region of the pattern for detecting the ejection state of the nozzle can be detected with accuracy to determine the ejection state of the nozzle. Therefore, even in a case where the image distortion is generated in the image as a result of reading out the test pattern by the reading device, for coping with the defective ejection or the defective ejection direction, ejection control by replacing the defective ejection nozzle or the defective ejection direction nozzle for a normal nozzle, that is, the control of so-called non-ejection detection can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-018946, filed Jan. 31, 2011, which is hereby incorporated by reference herein in its entirety.

What is claimed is:

1. An inkjet printing apparatus for ejecting ink from a print head for printing, comprising:

a printing device configured to print a pattern for detecting a defect in an ejection of ink from the print head;

a reading device configured to read out the printed pattern to obtain a reading result of the printed pattern;

a correcting device configured to obtain an ejection state of the ink for each of a plurality of analysis regions corresponding to the printed pattern based on the obtained reading result, and to correct a position of each analysis region based on the ejection state; and a determining device configured to determine the defect in the ejection of the ink from the print head based upon each analysis region where the position was corrected by the correcting device.

2. An inkjet printing apparatus according to claim 1, wherein the correcting device corrects the position of each analysis region based upon a density of the ink in each analysis region.

3. An inkjet printing apparatus according to claim 1, wherein a correction amount of the position of each analysis region to be corrected by the correcting device is determined based upon a difference amount between a theoretical ink position corresponding to the printed pattern read out by the reading device and an ink position which is obtained based on the reading result.

4. An inkjet printing apparatus according to claim 1, wherein the determining device determines whether or not an ejection state of the ink is normal based upon a maximum density value for each analysis region.

5. The inkjet printing apparatus according to claim 4, wherein the determining device further determines whether or not an ejection direction of the ink is normal based upon a position of the maximum density value in each analysis region.

6. An inkjet printing apparatus for printing by use of a print head having a plurality of nozzles ejecting ink, comprising:

a reading device configured to read out an image printed by the print head;

a control device configured to control the print head to print a pattern for detecting a defective ejection of each nozzle, and the reading device to read out the pattern; and a detecting device configured to set an analysis region for analyzing the pattern of the readout image on the readout image for each pattern of each nozzle to detect a defect of the ejection based upon a distribution state of a density of the pattern in the analysis region, wherein the detecting device corrects a position of the analysis region on the readout image determined based upon an arrangement of each nozzle on a design, corresponding to the distribution state of the density of the pattern in the analysis region.

7. An inkjet printing apparatus according to claim 6, wherein the detecting device corrects the position of the analysis region on the readout image determined based upon the arrangement of each nozzle on a design, corresponding to a distortion of the readout image.

8. An inkjet printing apparatus according to claim 6, wherein the detecting device corrects the position of the analysis region on the readout image determined based upon the arrangement of each nozzle on a design, corresponding to a peak position of the density distribution of the pattern in the analysis region.

9. An inkjet printing apparatus according to claim 8, wherein the detecting device corrects the position of the analysis region on the readout image determined based upon the arrangement of each nozzle on a design in the same way with a neighboring analysis region a position of which is already corrected, and further, corresponding to the peak position of the density distribution of the pattern in the analysis region.

10. An inkjet printing method for ejecting ink from a print head for printing, comprising:

printing a pattern for detecting a defect in an ejection of ink from the print head;

reading out the printed pattern to obtain a reading result of the printed pattern;

obtaining an ejection state of the ink for each of a plurality of analysis regions corresponding to the printed pattern based on the obtained reading result;

correcting a position of each analysis region based on the ejection state; and determining the defect in the ejection of the ink from the print head based upon each analysis region where the position was corrected.

11. An image processing method for ejecting ink from a print head provided with a plurality of nozzles, comprising:

printing a pattern for detecting a defective nozzle from among the plurality of nozzles;

obtaining a reading result by reading out the printed pattern;

obtaining an ejection state of the ink for each of a plurality of analysis regions corresponding to the printed pattern based on the obtained reading result;

correcting a position of each analysis region based on the ejection state; and determining whether or not the defective nozzle is included in the plurality of nozzles based upon each analysis region where a position was corrected.

* * * * *